US009725373B1

(12) United States Patent
Adams et al.

(10) Patent No.: US 9,725,373 B1
(45) Date of Patent: Aug. 8, 2017

(54) IGNITABLE SOLIDS HAVING AN ARRAYED STRUCTURE AND METHODS THEREOF

(71) Applicant: National Technology & Engineering Solutions of Sandia, LLC, Albuquerque, NM (US)

(72) Inventors: David P. Adams, Albuquerque, NM (US); Robert V. Reeves, Livermore, CA (US); Robert K. Grubbs, Albuquerque, NM (US); Michael David Henry, Albuquerque, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 0 days.

(21) Appl. No.: 14/739,956

(22) Filed: Jun. 15, 2015

(51) Int. Cl.
*C06B 45/04* (2006.01)
*C06B 33/00* (2006.01)
*C06B 21/00* (2006.01)

(52) U.S. Cl.
CPC ..... *C06B 45/04* (2013.01); *C06B 21/0083* (2013.01); *C06B 33/00* (2013.01)

(58) Field of Classification Search
CPC ..... C06B 45/04; C06B 45/08; C06B 21/0083
USPC ..... 102/275.11, 275.12, 275.9, 275.6, 311
See application file for complete search history.

(56) References Cited

U.S. PATENT DOCUMENTS 2,978,308 A * 4/1961 Keller ..... F02K 9/12 102/288
5,505,799 A 4/1996 Makowiecki
5,538,795 A 7/1996 Barbee, Jr. et al.
5,547,715 A 8/1996 Barbee, Jr. et al.
6,149,785 A 11/2000 Makowiecki et al.
6,298,784 B1 * 10/2001 Knowlton ..... C06B 45/00 102/205
6,336,611 B1 * 1/2002 Collinucci ..... B60J 9/00 102/306
6,578,254 B2 6/2003 Adams et al.
7,449,699 B1 11/2008 Adams et al.
7,568,431 B1 * 8/2009 Stria ..... F42B 4/24 102/202.14
7,829,157 B2 11/2010 Johnson et al.
7,951,247 B2 5/2011 Barbee, Jr. et al.
8,187,398 B2 5/2012 Gash et al.
8,227,297 B2 7/2012 Naundorf et al.
8,299,630 B2 10/2012 Braeuer et al.
8,328,967 B2 12/2012 Barbee, Jr. et al.
8,431,197 B2 4/2013 Fritz et al.
8,685,599 B1 4/2014 Adams et al.
2006/0207460 A1 * 9/2006 Reed ..... F42B 39/14 102/202.5

(Continued)

OTHER PUBLICATIONS

U.S. Appl. No. 14/632,838, filed Feb. 26, 2015, Hall et al.

(Continued)

*Primary Examiner* — Stephen M Johnson
(74) *Attorney, Agent, or Firm* — Helen S. Baca

(57) ABSTRACT

The present invention relates to the design and manufacture of an ignitable solid, where the solid is composed of an array of ignitable regions. In some examples, the array provides a three-dimensional periodic arrangement of such ignitable regions. The ignitable region can have any useful geometry and geometric arrangement within the solid, and methods of making such regions are also described herein.

34 Claims, 13 Drawing Sheets

(56) References Cited

U.S. PATENT DOCUMENTS

2013/0330567 A1 12/2013 Woll et al.
2015/0300790 A1* 10/2015 Huang ..... F42B 4/24
102/360

OTHER PUBLICATIONS

U.S. Appl. No. 14/923,031, filed Oct. 26, 2015, Kammler et al.
U.S. Appl. No. 15/239,631, filed Aug. 17, 2016, Adams et al.
U.S. Appl. No. 15/175,312, filed Jun. 7, 2016, Adams et al.
Aaltonen, T. et al., "Atomic Layer Deposition of Platinum Thin Films", Chem. Mat., 2003, pp. 1924-1938, vol. 15.
Adams, D.P., "Reactive Multilayers Fabricated by Vapor Deposition: A Critical Review", Thin Solid Films, 2015, pp. 98-128, vol. 576.
Adams, D.P., "Steady and Unsteady Propagation in Exothermic Multilayers," presented at the Gordon Research Conference on Energetic Materials held Jun. 15-20, 2014 in Newry, Maine (40 pp.).
Adams, D.P. et al., "Exothermic Reactions in Co/Al Nanolaminates", Journal of Applied Physics, 2008, pp. 043502-1-043502-7, vol. 104.
Adams, D.P. et al., "Reactive Ni/Ti Nanolaminates", Journal of Applied Physics, 2009, pp. 093505-1-093505-8, vol. 106.
Barron, S.C. et al., "Self-Propagating Reactions in Al/Zr Multilayers: Anomalous Dependence of Reaction Velocity and Bilayer Thickness", Journal of Applied Physics, 2013, pp. 223517-1-223517-10, vol. 114.
Gavens, A.J. et al., "Effect of Intermixing on Self-Propagating Exothermic Reactions in Al/Ni Nanolaminate Foils", Journal of Applied Physics, 2000, pp. 1255-1263, vol. 87.
Knepper, R. et al., "Effect of Varying Bilayer Spacing Distribution on Reaction Heat and Velocity in Reactive Al/Ni Multilayers", Journal of Applied Physics, 2009, pp. 083504-1-083504-9, vol. 105.
Miikkulainen, V. et al., "Crystallinity of Inorganic Films Grown by Atomic Layer Deposition: Overview and General Trends", Journal of Applied Physics, 2013, pp. 021301-1-021301-101, vol. 113.
Reeves, R.V. et al., "Condensed-Phase and Oxidation Reaction Behavior of Ti/2B Foils in Varied Gaseous Environments", The Journal of Physical Chemistry C, 2012, pp. 17904-17912, vol. 116.
Reeves, R.V. et al., "Reaction Instabilities in Co/Al Nanolaminates Due to Chemical Kinetics Variation Over Micron-Scales", Journal of Applied Physics, 2014, pp. 044911-1-044911-10, vol. 115.
Warne, L.K. et al., "Perturbation Theory in the Design of Degenerate spherical Dielectric Resonators", IEEE Transactions on Antennas and Propagation, 2013, pp. 2130-2141, vol. 61.

* cited by examiner

IGNITABLE SOLIDS HAVING AN ARRAYED STRUCTURE AND METHODS THEREOF

STATEMENT OF GOVERNMENT INTEREST

This invention was made with Government support under contract no. DE-AC04-94AL85000 awarded by the U.S. Department of Energy to Sandia Corporation. The Government has certain rights in the invention.

FIELD OF THE INVENTION

The present invention relates to the design and manufacture of an ignitable solid, where the solid is composed of an array of ignitable regions. In some examples, the array provides a three-dimensional periodic arrangement of such ignitable regions.

BACKGROUND OF THE INVENTION

Ignitable solids are materials that rapidly evolve energy (e.g., heat and/or light) when stimulated at a point or when raised to a characteristic temperature. Generally comprised of two or more reactants, these materials are often constructed in a heterogeneous form that includes spaced or separated reactants. In some uses, a close spacing and an intimate contact of reactants are often key to promoting efficient mixing and rapid chemical reaction at the time of ignition. Upon ignition, ignitable solids can rapidly evolve heat, which in turn can drive a self-propagating chemical reaction within the solid that partially or completely mixes all of the reactants.

Controlling the spacing within ignitable solids can be challenging. For instance, it may be beneficial to provide reactants having periodic spacing on a nanometer- or micrometer-scale. However, fabrication methods to control such spacing depend on the desired spacing, the type of reactant(s), as well as other experimental factors. Thus, there is a need for additional methods and compositions for ignitable solids having controlled spacing and dimensions.

SUMMARY OF THE INVENTION

The present invention is directed to an ignitable, heterogeneous solid having an arrangement of reactants constructed with a periodic or aperiodic structure. In particular embodiments, the ignitable solid includes a three-dimensional scaffold having one or more reactants arranged in a three-dimensional array within that scaffold. In yet other embodiments, the ignitable solid is a component in an assembly including any other useful component(s) (e.g., a delay line, an ignitable via, a substrate, etc., or any other component described herein). The ignitable solid can be employed in any useful manner, such as a heat source, an optical switch, an igniter, a decoy flare, a fuse, a solder source, a brazing source, etc. Additional details for such ignitable solids, assemblies, and components, as well as methods for forming such compositions, are described herein.

In one aspect, the invention features an ignitable solid including a scaffold (e.g., a three-dimensional scaffold); and a plurality of ignitable regions, where each ignitable region is disposed within the scaffold and at least one ignitable region includes a first reactant (e.g., any described herein, including a first reactant with a second, third, fourth, etc. reactant, including those from any reactant combination described herein). In some embodiments, the plurality of ignitable regions forms a three-dimensional array disposed within the scaffold.

In one embodiment, the scaffold includes a second reactant, where the first and second reactants are configured to undergo an exothermic reaction. In particular embodiments, the second reactant is disposed within the scaffold. In other embodiments, the first reactant and second reactant are configured as a multilayer. Both first and second reactants can be optionally located within an opening of the scaffold.

In one embodiment, the scaffold is formed from a first material, and the first reactant and the first material are configured to undergo an exothermic reaction. In other embodiments, the first material, first reactant, and other reactants are selected from any material described herein.

In another embodiment, the ignitable region further includes a second reactant. In further embodiments, the first and second reactants are configured to undergo an exothermic reaction.

In one embodiment, the scaffold includes a plurality of openings, and where at least one ignitable region is disposed within at least one opening. In particular embodiments, a first reactant and/or a second reactant is disposed within at least one opening (e.g., within each opening). In other embodiments, the first reactant and second reactant are configured as a multilayer.

In another aspect, the invention features an assembly including an ignitable solid (e.g., any described herein); and a first delay line located in proximity to the ignitable solid. In further embodiments, the assembly includes a first ignitable via disposed between the first delay line and the ignitable solid.

In another aspect, the invention features an assembly including: a first delay line including an ignitable solid (e.g., any described herein); and an ignitable via disposed in proximity to (e.g., in contact with) the first delay line.

In yet another aspect, the invention features an assembly including: a three-dimensional scaffold; a plurality of ignitable regions, where each ignitable region is disposed within the scaffold and at least one ignitable region includes one or more reactants; and one or more delay lines (e.g., in proximity to a scaffold, an ignitable region, or an ignitable via).

In another aspect, the invention features an optical switch including: an ignitable solid (e.g., any described herein), where the solid includes two or more transparent reactants configured to undergo and/or propagate an exothermic reaction that produces a non-transparent or a semi-transparent reaction product.

In another aspect, the invention features a method including: providing a three-dimensional scaffold including one or more openings, where the openings form a three-dimensional array disposed within the scaffold; and depositing one or more reactants within the one or more openings (e.g., each and every opening), thereby forming an ignitable solid.

In some embodiments, the depositing step includes: depositing a first reactant within a first opening; and depositing a second reactant that overlies the deposited first reactant, thereby forming a multilayer within the first opening.

In some embodiments, the depositing step includes atomic layer deposition, vapor deposition, plasma-assisted atomic layer deposition, and/or chemical vapor deposition (e.g., of one or more reactants within the scaffold or within one or more openings of the scaffold). Optionally, the method includes planarizing a surface of a stack or an ignitable solid.

In some embodiments, the method includes, prior to the providing step: forming one or more openings within the scaffold by sputtering, etching, ablating, and/or coring a surface of the scaffold.

In some embodiments, the method includes deforming the ignitable solid into a non-planar configuration; and directly igniting the ignitable solid or indirectly igniting the ignitable solid (e.g., by way of one or more delay lines and/or ignitable vias).

In any embodiment herein, at least one ignitable region (e.g., each ignitable region) and/or opening includes a cylinder, a cone, a pore, or a multilayer. In some embodiments, each ignitable region includes one or more reactants (e.g., any described herein). In other embodiments, the scaffold includes one or more reactants (e.g., any described herein). In yet other embodiments, each of the reactants within the ignitable region is configured to react with each other in an exothermic reaction. In some embodiments, each of the reactant(s) within the ignitable region and the scaffold material are configured to react with each other in an exothermic reaction.

In any embodiment herein, the three-dimensional array includes a periodic pattern (e.g., a rectangular, a hexagonal, or a rhombohedral pattern) or an aperiodic pattern.

In any embodiment herein, the solid further includes an ignition site in proximity to at least one ignitable region, ignitable via, and/or delay line.

In any embodiment herein, at least one ignitable region has a dimension that is of from about 0.01 μm to about 1 mm (e.g., from about 0.01 μm to about 400 μm; or from about 0.01 μm to about 300 μm). In some embodiments, a center-to-center spacing between two ignitable regions is 10 μm or less (e.g., of from about 0.01 μm to about 10 μm) or of from about 0.5 nm to about 300 μm.

In any embodiment herein, the scaffold and/or ignitable region include silicon, carbon, aluminum, a fluorocarbon, a reactant, or an inert material (e.g., any described herein). Exemplary reactants include those from a reactant combination, a transition metal, a lanthanoid, a metal, a metalloid, an organic, and/or a metal oxide (e.g., any described herein).

In any embodiment herein, the assembly further includes a substrate disposed between a delay line and an ignitable solid. In some embodiments, an ignitable via is optionally disposed within the substrate and/or in proximity to an ignitable solid or a delay line.

In any embodiment herein, the ignitable solid, assembly, or method includes a delay line (e.g., a first delay line), which is configured to ignite the ignitable solid.

In any embodiment herein, the ignitable solid, assembly, or method includes a delay line (e.g., a first delay line), which includes an ignitable solid. In some embodiments, the delay line has a first end and a second end, where the first end is disposed in proximity to an ignition site (e.g., located on and/or near an ignitable solid). In other embodiments, the second end of the first delay line is disposed in proximity to at least one ignitable region.

In any embodiment herein, the ignitable solid, assembly, or method includes an ignitable via, which includes one or more reactants configured to undergo and/or propagate an exothermic reaction. In some embodiments, the ignitable via includes an ignitable solid and has a first end and a second end, where the first end is disposed in proximity to the first delay line and the second end is disposed in proximity to at least one ignitable region.

The ignitable solid or assembly can have any useful configuration, such as a bulk solid, a monolithic structure, a foil, a coating, or a delay line; and any useful property (e.g., semi-transparent or transparent property prior to ignition and/or an opaque property after ignition and reaction). In any embodiment herein, the first and second reactants are configured to undergo an exothermic reaction that produces a non-transparent reaction product.

Definitions

As used herein, the term "about" means +/−10% of any recited value. As used herein, this term modifies any recited value, range of values, or endpoints of one or more ranges.

By "micro" is meant having at least one dimension that is less than 1 mm. For instance, a microstructure (e.g., any structure described herein) can have a length, width, height, cross-sectional dimension, circumference, radius (e.g., external or internal radius), or diameter that is less than 1 mm.

By "nano" is meant having at least one dimension that is less than 1 μm. For instance, a nanostructure (e.g., any structure described herein) can have a length, width, height, cross-sectional dimension, circumference, radius (e.g., external or internal radius), or diameter that is less than 1 μm.

As used herein, the terms "top," "bottom," "upper," "lower," "above," and "below" are used to provide a relative relationship between structures. The use of these terms does not indicate or require that a particular structure must be located at a particular location in the apparatus.

Other features and advantages of the invention will be apparent from the following description and the claims.

DETAILED DESCRIPTION OF THE INVENTION

The present invention relates to an ignitable solid having a plurality of ignitable regions arranged in any useful array (e.g., a two-dimensional or three-dimensional array having periodic or aperiodic patterns). In particular, the ignitable solid includes one or more reactants (e.g., two or more reactants, such as a combination of two or more reactants described herein), where such reactants undergo or promote an exothermic reaction.

The ignitable solid can have any useful structure (e.g., any useful geometry, periodic or aperiodic pattern, assembly, etc.). In one instance, the ignitable solid includes an array of ignitable regions. The ignitable region can include any useful combination of one or more reactants that propagate, undergo, or promote an exothermic reaction. The release of energy (e.g., heat or light) that is associated with reactant mixing can be sufficient to drive a propagating, high temperature chemical reaction and fully transform the solid into a new product phase. The individual reactants (e.g., located within a single ignitable region or located in separate ignitable regions) can take on any number of shapes (e.g., disposed in openings of any useful geometry, such as those described herein) or be arranged with a variety of different symmetries (e.g., a periodic or aperiodic pattern arranged in any dimension).

Figure 1A:
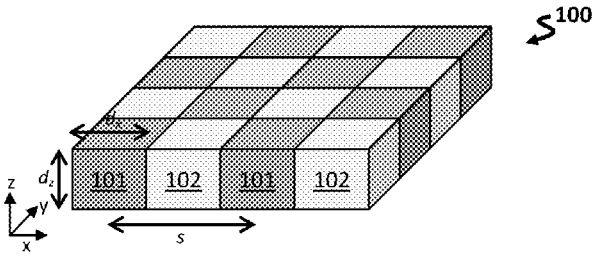
FIG. 1A-1D shows exemplary ignitable solids, each including an array of two different reactants. Provided are (A) an exemplary ignitable solid 100 having a two-dimensional array of reactants 101,102; (B) another exemplary ignitable solid 1000 having a three-dimensional array of reactants 1001,1002; (C) a further ignitable solid 1100 having a three-dimensional array of reactants 1102,1103 disposed in a scaffold 1101; and (D) a cross-sectional view along line 1D-1D of the ignitable solid 1100.

FIG. 1A shows an exemplary solid 100 having an array of ignitable regions, in which one set of regions includes a first reactant 101 and a second set of regions includes a second reactant 102. As can be seen, the pattern of the ignitable regions is characterized by a periodic spacing s, which is the center-to-center spacing between ignitable regions. In addition, each ignitable region can be of any useful dimension d (e.g., a dimension d of a length, width, height, thickness, diameter, or radius of the entire ignitable region, a component (e.g., a layer) of a region, or a reactant within that region, in and along any useful axis). For instance, an ignitable region in FIG. 1A is characterized by a first dimension d along the x-axis ($d_x$) and a second dimension d along the z-axis ($d_x$), and each ignitable region can have the same or different characteristic dimension d.

Spacing s and dimension d can be of any useful dimension, such as of from about 0.5 nm to about 300 μm (e.g., 0.5 nm to 5 nm, 0.5 nm to 10 nm, 0.5 nm to 25 nm, 0.5 nm to 50 nm, 0.5 nm to 75 nm, 0.5 nm to 100 nm, 0.5 nm to 250 nm, 0.5 nm to 500 nm, 0.5 nm to 750 nm, 0.5 nm to 1 μm, 0.5 nm to 5 μm, 0.5 nm to 10 μm, 0.5 nm to 25 μm, 0.5 nm to 50 μm, 0.5 nm to 75 μm, 0.5 nm to 100 μm, 0.5 nm to 150 μm, 0.5 nm to 200 μm, 1 nm to 5 nm, 1 nm to 10 nm, 1 nm to 25 nm, 1 nm to 50 nm, 1 nm to 75 nm, 1 nm to 100 nm, 1 nm to 250 nm, 1 nm to 500 nm, 1 nm to 750 nm, 1 nm to 1 μm, 1 nm to 5 μm, 1 nm to 10 μm, 1 nm to 25 μm, 1 nm to 50 μm, 1 nm to 75 μm, 1 nm to 100 μm, 1 nm to 150 μm, 1 nm to 200 μm, 1 nm to 300 μm, 2 nm to 10 nm, 2 nm to 25 nm, 2 nm to 50 nm, 2 nm to 75 nm, 2 nm to 100 nm, 2 nm to 250 nm, 2 nm to 500 nm, 2 nm to 750 nm, 2 nm to 1 μm, 2 nm to 5 μm, 2 nm to 10 μm, 2 nm to 25 μm, 2 nm to 50 μm, 2 nm to 75 μm, 2 nm to 100 μm, 2 nm to 150 μm, 2 nm to 200 μm, 2 nm to 300 μm, 10 nm to 25 nm, 10 nm to 50 nm, 10 nm to 75 nm, 10 nm to 100 nm, 10 nm to 250 nm, 10 nm to 500 nm, 10 nm to 750 nm, 10 nm to 1 μm, 10 nm to 5 μm, 10 nm to 10 μm, 10 nm to 25 μm, 10 nm to 50 μm, 10 nm to 75 μm, 10 nm to 100 μm, 10 nm to 150 μm, 10 nm to 200 μm, 10 nm to 300 μm, 30 nm to 50 nm, 30 nm to 75 nm, 30 nm to 100 nm, 30 nm to 250 nm, 30 nm to 500 nm, 30 nm to 750 nm, 30 nm to 1 μm, 30 nm to 5 μm, 30 nm to 10 μm, 30 nm to 25 μm, 30 nm to 50 μm, 30 nm to 75 m, 30 nm to 100 μm, 30 nm to 150 μm, 30 nm to 200 μm, 30 nm to 300 μm, 50 nm to 75 nm, 50 nm to 100 nm, 50 nm to 250 nm, 50 nm to 500 nm, 50 nm to 750 nm, 50 nm to 1 μm, 50 nm to 5 μm, 50 nm to 10 μm, 50 nm to 25 μm, 50 nm to 50 μm, 50 nm to 75 μm, 50 nm to 100 μm, 50 nm to 150 μm, 50 nm to 200 μm, 50 nm to 300 μm, 100 nm to 250 nm, 100 nm to 500 nm, 100 nm to 750 nm, 100 nm to 1 μm, 100 nm to 5 μm, 100 nm to 10 μm, 100 nm to 25 μm, 100 nm to 50 μm, 100 nm to 75 μm, 100 nm to 100 μm, 100 nm to 150 μm, 100 nm to 200 μm, 100 nm to 300 μm, 300 nm to 500 nm, 300 nm to 750 nm, 300 nm to 1 μm, 300 nm to 5 μm, 300 nm to 10 μm, 300 nm to 25 μm, 300 nm to 50 μm, 300 nm to 75 μm, 300 nm to 100 μm, 300 nm to 150 μm, 300 nm to 200 μm, 300 nm to 300 μm, 500 nm to 750 nm, 500 nm to 1 μm, 500 nm to 5 μm, 500 nm to 10 μm, 500 nm to 25 μm, 500 nm to 50 μm, 500 nm to 75 μm, 500 nm to 100 μm, 500 nm to 150 μm, 500 nm to 200 μm, 500 nm to 300 μm, 1 μm to 5 μm, 1 μm to 10 μm, 1 μm to 25 μm, 1 μm to 50 μm, 1 μm to 75 μm, 1 μm to 100 μm, 1 μm to 150 μm, 1 μm to 200 μm, 1 μm to 300 μm, 5 μm to 10 μm, 5 μm to 25 μm, 5 μm to 50 μm, 5 μm to 75 μm, 5 μm to 100 μm, 5 μm to 150 μm, 5 μm to 200 μm, 5 μm to 300 μm, 10 μm to 25 μm, 10 μm to 50 μm, 10 μm to 75 μm, 10 μm to 100 μm, 10 μm to 150 μm, 10 μm to 200 μm, 10 μm to 300 μm, 30 μm to 50 μm, 30 μm to 75 μm, 30 μm to 100 μm, 30 μm to 150 μm, 30 μm to 200 μm, 30 μm to 300 μm, 50 μm to 75 μm, 50 μm to 100 μm, 50 μm to 150 μm, 50 μm to 300 μm, 75 μm to 100 μm, 75 μm to 150 μm, 75 μm to 300 μm, 100 μm to 150 μm, 100 μm to 300 μm, 150 μm to 300 μm, or 200 μm to 300 μm), as well along any useful axis (e.g., along an edge of the solid, a diagonal along a face of the solid, or along an x-, y-, or z-axis, as shown in FIG. 1A).

Figure 1B:
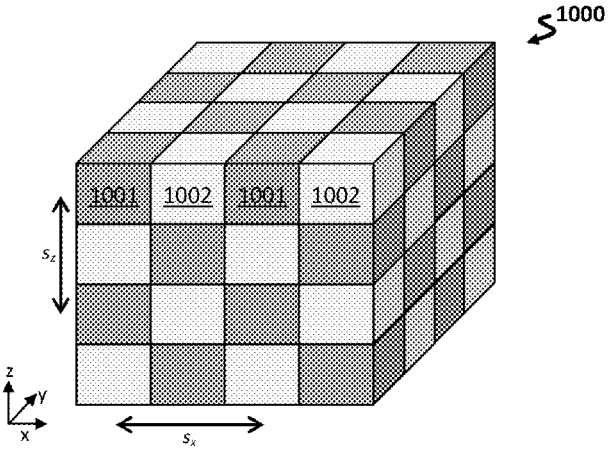

In another example, FIG. 1B shows an exemplary solid 1000 having an array of ignitable regions, in which one set of regions includes a first reactant 1001 and a second set of regions includes a second reactant 1002. Here, the array is arranged in a three-dimensional manner, in which the array extends in a pattern along the x-, y-, and z-axes. The ignitable solid can have any useful pattern (or arrangement within an array). For the solid 1000 in FIG. 1B, the three-dimensional array includes an A-B-A-B pattern along each of the x-, y-, and z-axes, in which A is a first reactant and B is a second reactant.

Each ignitable region can be arranged in any useful manner. In one instance, each ignitable region can contact (e.g., directly or indirectly) another ignitable region. For example, in FIG. 1B, an ignitable region of a first reactant 1001 is in physical proximity (e.g., direct contact) to a second ignitable region of a second reactant 1002. In another instance, each ignitable region (or set thereof) is separated from another ignitable region (or set thereof). This separation can be effected in any useful manner, such as by disposing an inert material between ignitable regions or by disposing ignitable regions within openings arrayed on or within a scaffold material.

Figure 1C:
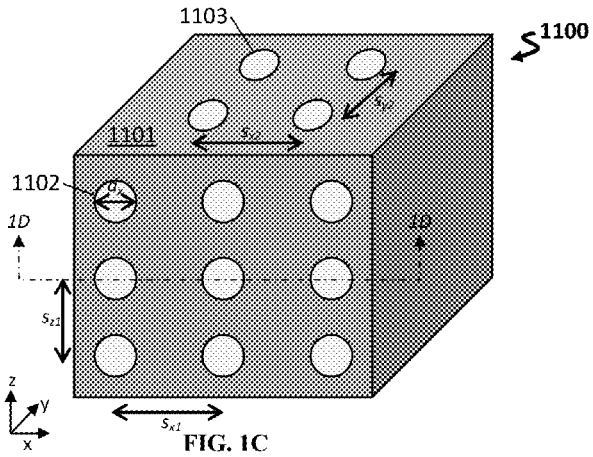

Each set of ignitable regions (e.g., a plurality of ignitable regions, including a set within said plurality of regions) can have any useful arrangement or pattern, e.g., each set can have a same or different arrangement within a particular face or location of the solid. For example, FIG. 1C shows an exemplary solid 1100 having a scaffold 1101 including a first set of ignitable regions 1102 arranged in a pattern on an x-z face of the solid, as well as a second set of ignitable regions 1103 arranged in a pattern on an x-y face of the solid. As can be seen, the first and second set have a different pattern (e.g., a 3×3 pattern for the first set of ignitable regions 1102 and a 2×2 pattern for the second set of ignitable regions 1103). Each pattern can have any useful characteristic dimension d, such as a size of the entire ignitable region (e.g., a diameter $d_x$ for the ignitable region 1102), as well as each characteristic spacing s (e.g., a center-to-center spacing along the x- and z-axes for the first set of ignitable regions, which are shown as spacing $s_{x1}$ and $s_{z1}$, respectively, in FIG. 1C; and a center-to-center spacing along the x- and y-axes for the second set of ignitable regions, which are shown as spacing $s_{x2}$ and $s_{y2}$, respectively, in FIG. 1C).

Figure 1D:
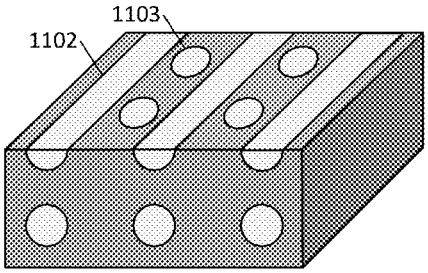

In addition, each set can extend along any useful dimension. For instance, each ignitable region, or set thereof, can extend along the direction of viewing for a particular side or face of the ignitable solid. As seen in FIG. 1C, a first ignitable region 1102 is disposed on the x-z face of the solid and has a direction of viewing along the y-axis, and the longitudinal axis of the first ignitable region 1102 extends along this y-axis (FIG. 1D). In addition, the longitudinal axis of the second ignitable region 1103 extends along the z-axis with a direction of viewing along the z-axis (FIG. 1D).

For the solid 1100 in FIG. 1C, when undergoing a reaction, the chemical wavefront of the reaction would extend radially from the ignitable region and along the x-z face, yet still be viewable along the direction of viewing (along the y-axis). Thus, in some example, the ignitable region is spatially arranged on a face of the solid, where the face is configured to be viewed along a direction of viewing in a first axis. In a further example, the ignitable region is arranged in a pattern defined along a first plane that is orthogonal or perpendicular to the viewing axis (e.g., a pattern defined in an y-z plane with a direction of viewing along the x-axis, a pattern defined in an x-z plane with a direction of viewing along the y-axis, or a pattern defined in an x-y plane with a direction of viewing along the z-axis).

Arrays of reactants can provide any useful benefit. In one instance, such arrays can provide an increased interface density (e.g., an increase in the number of interfaces between two or more reactants, which exothermic reactions generally initiate at such interfaces). In comparison, a one-dimensional periodic structure has a limited number of interfaces (e.g., an interface located between two planes, where each plane includes a reactant) because the interfaces only extend along a particular plane and patterns of interfaces are established along a single dimension (e.g., a plane of a first reactant in the x-y dimension and a plane of a second reactant in the x-y dimension, where a stack of these planes provide an interface that extends along the x-y plane but the periodic pattern of these planes is established along the z-axis, e.g., by stacking two or more planes). Using the arrays described herein, an increased interface density can lead to larger heat release rates and/or faster reaction propagation speeds.

In another embodiment, the arrays and ignitable solids herein provide a regular pattern (e.g., as compared with current powder compacts) having a more ordered and/or controlled pattern. For instance, current powder compacts provide a general three-dimensional structure, but the pattern of the particular reactants is irregular. In contrast, in some embodiments, the arrays, ignitable solids, and assemblies herein possess a more ordered pattern, which in turn provides, e.g., a more reliable point ignition and a more uniform heat release rate. For instance, the ability to design the reactant spacing and array symmetry should provide ways to tailor the reaction rate in each direction of periodicity in an independent manner. For instance, by controlling the spacing along the x-axis independently from spacing along the y-axis provides a tailorable ignitable solid.

The ignitable solid can have any useful dimension to facilitate particular reaction wavefronts and reaction rates, as well as particular dimensions to provide a flexible interface. In some embodiments, the ignitable solid is a flexible structure configured to conform to a non-planar surface. In some embodiments, the ignitable solid is a rigid structure.

The reactants may be located in any useful region of the ignitable solid. In some instances, one or more reactants are located within an ignitable region. Within that region, one reactant can be included. Alternatively, two or more reactants can be included within each ignitable region, such as alternating layers of a first reactant and layers of a second reactant. In other instances, two or more reactants are located within an opening of the solid. In yet other instances, a scaffold includes one or more reactants, and one or more reactants are located within an opening of the solid.

Figure 2A:
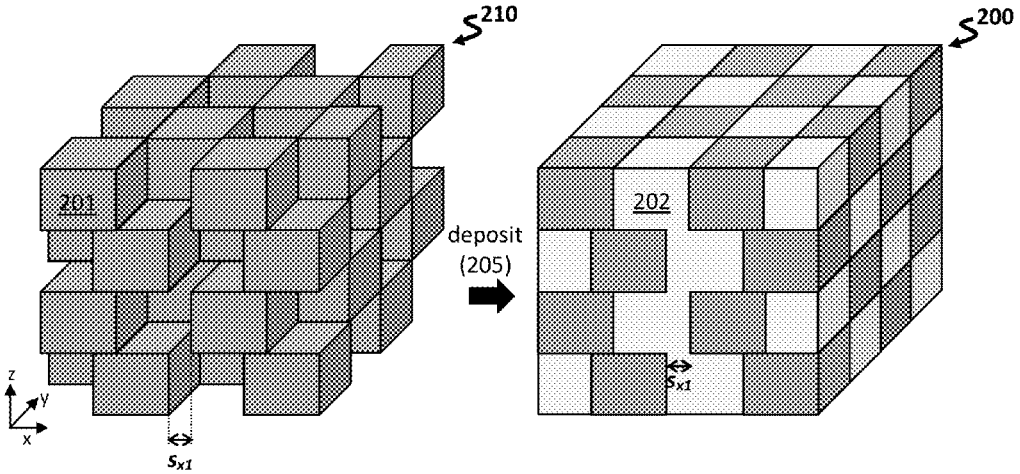
FIG. 2A-2B shows exemplary methods for forming an ignitable solid. Provided are (A) an exemplary method for forming an ignitable solid 200 from an underlying scaffold 210; and (B) an exemplary method for forming an ignitable solid 2030 from an underlying scaffold 2010 and building additional scaffold and reagent layers to form a three-dimensional array.

The ignitable solid can include a scaffold, into which one or more reactants are deposited. In this methodology, the deposited reactants constitute the ignitable regions. Alternatively, if the scaffold itself is composed of a reactant, then portions of the scaffold constitute ignitable regions; and the deposited reactants are also designated as ignitable regions. FIG. 2A provides an exemplary solid 200 including an underlying scaffold 210 composed of a first material 201 (e.g., an inert material or a reactant, such as any described herein) and including one or more openings between such material. Then, a reactant 202 is deposited 205 to form ignitable regions disposed within the scaffold 210. As can be seen, the scaffold 210 includes an opening having a characteristic spacing $s_{x1}$ that is located between rectangular regions, which can be modified to control reaction rates between the reactants (e.g., between a reactant of the scaffold and the disposed reactant, or between two ignitable regions that are each composed of a disposed reactant).

The dimensions of the openings (and the resultant ignitable regions) can also be modified to control the propagation of the reaction. In one instance, the opening has a high aspect ratio, e.g., a ratio of a first dimension and a second dimension that is of from about 1:5 to about 1:200, e.g., 1:5 to 1:200, 1:5 to 1:175, 1:5 to 1:150, 1:5 to 1:125, 1:5 to 1:100, 1:5 to 1:90, 1:5 to 1:75, 1:5 to 1:50, 1:5 to 1:25, 1:5 to 1:10, 1:10 to 1:200, 1:10 to 1:175, 1:10 to 1:150, 1:10 to 1:125, 1:10 to 1:100, 1:10 to 1:90, 1:10 to 1:75, 1:10 to 1:50, 1:10 to 1:25, 1:15 to 1:200, 1:15 to 1:175, 1:15 to 1:150, 1:15 to 1:125, 1:15 to 1:100, 1:15 to 1:90, 1:15 to 1:75, 1:15 to 1:50, 1:15 to 1:25, 1:20 to 1:175, 1:20 to 1:150, 1:20 to 1:125, 1:20 to 1:100, 1:20 to 1:90, 1:20 to 1:75, 1:20 to 1:50, 1:20 to 1:25, 1:25 to 1:200, 1:25 to 1:175, 1:25 to 1:150, 1:25 to 1:125, 1:25 to 1:100, 1:25 to 1:90, 1:25 to 1:75, 1:25 to 1:50, 1:30 to 1:200, 1:30 to 1:175, 1:30 to 1:150, 1:30 to 1:125, 1:30 to 1:100, 1:30 to 1:90, 1:30 to 1:75, 1:30 to 1:50, 1:50 to 1:200, 1:50 to 1:175, 1:50 to 1:150, 1:50 to 1:125, 1:50 to 1:100, 1:50 to 1:90, or 1:50 to 1:75. Such high aspect ratios could be optimized to control the direction of the propagated reaction, such as a direction along the length of an opening (e.g., a length along the z-direction).

The opening can have any useful characteristic dimension, such as a length, width, height, radius, thickness, diameter, etc. The dimension can be less than 400 μm or of from about 0.01 μm to about 400 μm (e.g., 0.01 μm to 400 μm, 0.01 μm to 300 μm, 0.01 μm to 250 μm, 0.01 μm to 200 μm, 0.01 μm to 150 μm, 0.01 μm to 100 μm, 0.01 μm to 75 μm, 0.01 μm to 50 μm, 0.01 μm to 25 μm, 0.01 μm to 10 μm, 0.01 μm to 5 μm, 0.01 μm to 1 μm, 0.01 μm to 0.5 μm, 0.01 μm to 0.1 μm, 0.1 μm to 400 μm, 0.1 μm to 300 μm, 0.1 μm to 250 μm, 0.1 μm to 200 μm, 0.1 μm to 150 μm, 0.1 μm to 100 μm, 0.1 μm to 75 μm, 0.1 μm to 50 μm, 0.1 μm to 25 μm, 0.1 μm to 10 μm, 0.1 μm to 5 μm, 0.1 μm to 1 μm, 0.1 μm to 0.5 μm, 0.5 μm to 400 μm, 0.5 μm to 300 μm, 0.5 μm to 250 μm, 0.5 μm to 200 μm, 0.5 μm to 150 μm, 0.5 μm to 100 μm, 0.5 μm to 75 μm, 0.5 μm to 50 μm, 0.5 μm to 25 μm, 0.5 μm to 10 μm, 0.5 μm to 5 μm, 0.5 μm to 1 μm, 1 μm to 400 μm, 1 μm to 300 μm, 1 μm to 250 μm, 1 μm to 200 μm, 1 μm to 150 μm, 1 μm to 100 μm, 1 μm to 75 μm, 1 μm to 50 μm, 1 μm to 25 μm, 1 μm to 10 μm, 1 μm to 5 μm, 5 μm to 400 m, 5 μm to 300 μm, 5 μm to 250 μm, 5 μm to 200 μm, 5 μm to 150 μm, 5 μm to 100 μm, 5 μm to 75 μm, 5 μm to 50 μm, 5 μm to 25 μm, 5 μm to 10 μm, 10 μm to 400 μm, 10 μm to 300 μm, 10 μm to 250 μm, 10 μm to 200 μm, 10 μm to 150 μm, 10 μm to 100 μm, 10 μm to 75 μm, 10 μm to 50 μm, 10 μm to 25 μm, 25 μm to 400 μm, 25 μm to 300 μm, 25 μm to 250 μm, 25 μm to 200 μm, 25 μm to 150 μm, 25 μm to 100 μm, 25 μm to 75 μm, 25 μm to 50 μm, 50 μm to 400 μm, 50 μm to 300 μm, 50 μm to 250 μm, 50 μm to 200 μm, 50 μm to 150 μm, 50 μm to 100 μm, 50 μm to 75 μm, 100 μm to 400 μm, 100 μm to 300 μm, 100 μm to 250 μm, 100 μm to 200 μm, 100 μm to 150 μm, 200 μm to 400 μm, 200 μm to 300 μm, 200 μm to 250 μm, 250 μm to 400 μm, 250 μm to 300 μm, 300 μm to 400 μm, or 350 μm to 400 μm).

Figure 2B:
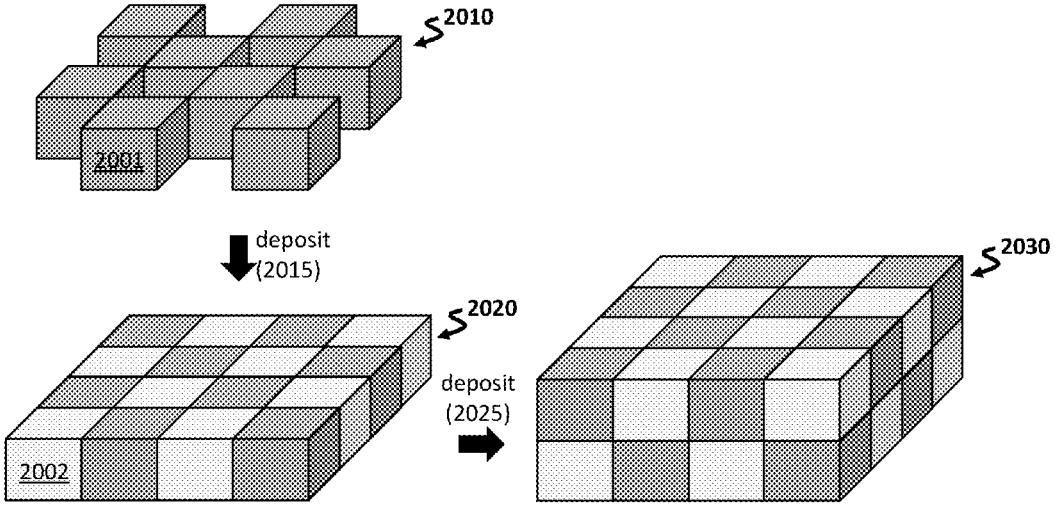

Openings within scaffold can have any useful pattern or geometry. Exemplary patterns include periodic and aperiodic patterns, including multilayers. Exemplary geometries include pores, cylinders, spheres, spheroids, as well as irregular geometric shapes. Such openings can be connected (e.g., by way of nanochannels) or not connected (e.g., by having a portion of the substrate disposed between openings). Each opening within the scaffold can have same or different geometries. In addition, the pattern of openings can be uniform Scaffolds can be formed and employed in any useful manner. For example, FIG. 2A shows an exemplary scaffold 210 that is built to form a three-dimensional structure composed of a first compound 201 (e.g., a reactive reactant or an inert material). The scaffold can be a structure that is built layer-by-layer (e.g., in the z-direction) by any useful methodology to from a three-dimensional structure, e.g., by spray deposition or physical vapor deposition, including atomic layer deposition, sputter deposition, electron beam evaporation, thermal evaporation, and cold spray deposition. For example, FIG. 2B shows another exemplary scaffold 2010 composed of a first compound 2001, in which a reactant 2002 is deposited 2015 to form ignitable regions disposed within the scaffold 2010, thereby forming a single-layered ignitable solid 2020. Additional layers can be deposited 2025 in an iterative manner to provide a three-dimensional ignitable solid 2030.

In addition, the scaffold can be cast by using any molding process. In yet another embodiment, the scaffold is a monolithic structure having one or more openings (e.g., pores). In one embodiment, the scaffold is fabricated by forming one or more openings in a bulk substrate (e.g., a bulk reactant or a bulk inert material), e.g., by Bosch etching, focused ion beam sputtering, laser ablation (e.g., pulsed laser ablation), interference lithography, or combinations of any of these techniques. For instance, treating a surface with energetic material (e.g., ions, photon irradiation, or incident beams) can damage regions of the substrate, and these damaged regions can be preferentially removed by exposing the surface to an etchant, an acid, or an oxidative solution.

A substrate (or scaffold) can include any useful structure, such as a planar or non-planar surface. In addition, the substrate can have any useful geometry, such as an enclosed (filled) sphere, an opened sphere, a cube, a cuboid, a plane, a tube, a cylinder, etc. In this manner, the three-dimensional structure of the ignitable solid can be controlled. For instance, a tube substrate can be used to deposit a first reactant within the void of that tube, thereby forming a first ignitable region disposed above the surface of the substrate (or a portion of that surface). Then, a second reactant can be deposited on a layer of that first reactant, thereby forming a multilayered structure ignitable solid disposed within a void of the tube. Thus, the geometry of the ignitable solid is determined by the underlying geometry of the substrate. The tube may be formed from a reactant or an inert material. In another instance, a solid cylindrical substrate is employed, and a layer of a first reactant is disposed on the outward surface of that cylindrical substrate (or a portion of that surface). Again, a second reactant can be deposited on a layer of that first reactant, thereby forming a multilayered ignitable solid disposed on the outer surface of the cylindrical substrate. Other geometries for the substrate and the ignitable solid are encompassed by the present invention.

Furthermore, ignitable regions can be formed and employed in any useful manner. The ignitable region can be within a scaffold or disposed within a scaffold. In addition, the scaffold itself may be composed of ignitable regions (e.g., based on the material(s) used to compose the scaffold).

Fabrication Methods

The ignitable solid can be formed in any useful manner. For instance, the scaffold can be first formed, and then ignitable regions can be formed. Alternatively, a two-dimensional ignitable solid (e.g., a two-dimensional scaffold including ignitable regions) is first formed, and then additional scaffold layers are deposited to form a three-dimensional solid. Then, one or more reactants are further deposited within any opening of the scaffold layer(s).

Figure 3:
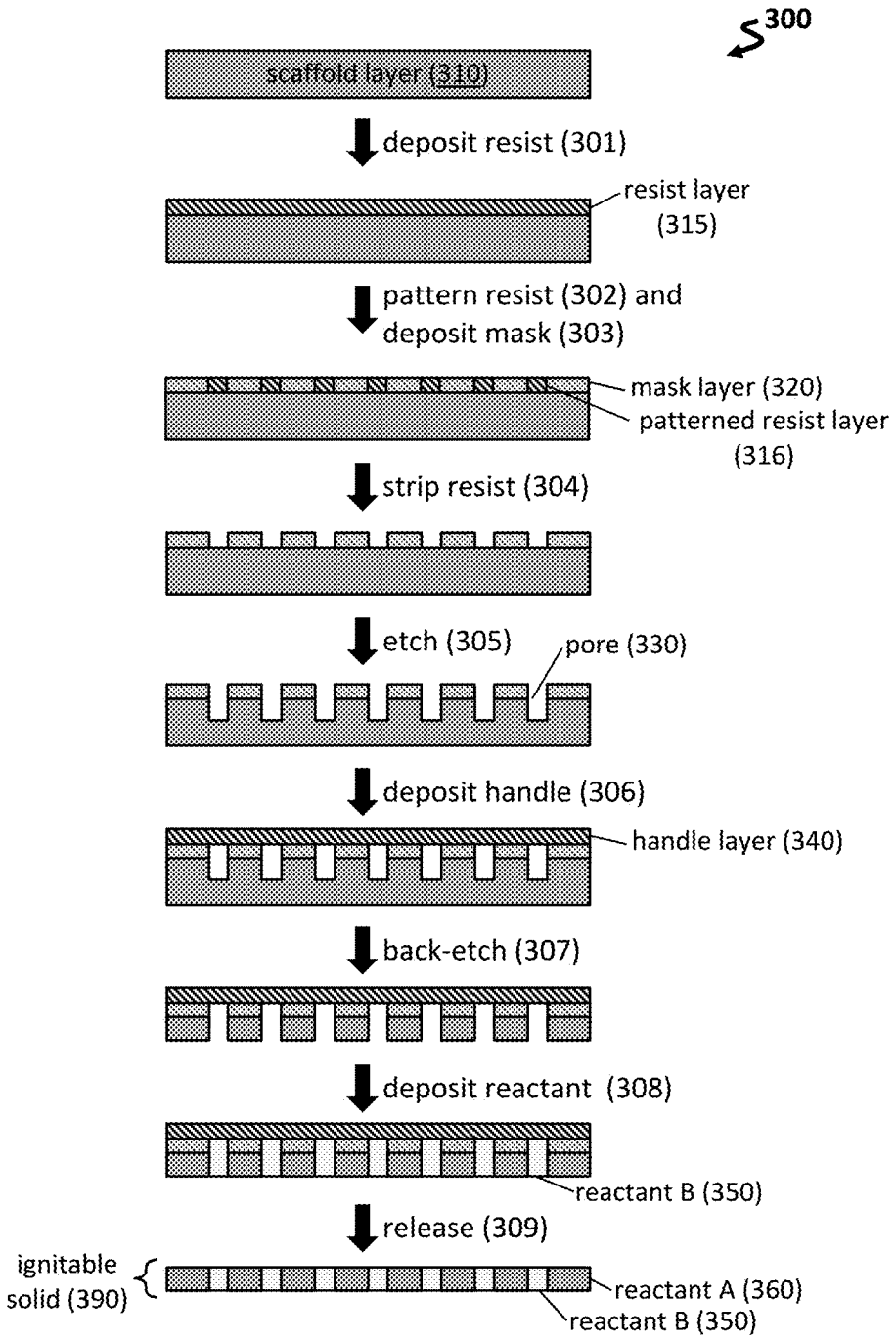
FIG. 3 shows an exemplary method 300 for forming an ignitable solid 390 formed of two reactants 350,360.

FIG. 3 shows an exemplary method 300 of fabricating a two-dimensional solid including two materials, e.g., a first reactant and a second reactant. In FIG. 3, the scaffold is composed of reactant A, and the ignitable region is composed of reactant B. Both reactants can constitute ignitable regions, or one of reactants A or B can be an inert material. In one instance, the scaffold includes reactant A of silicon. The two-dimensional solid can include, e.g., a two-dimensional periodic array of reactant B within a scaffold layer of reactant A, thereby forming an ignitable, heterogeneous solid.

In one instance, the method includes providing a scaffold layer (e.g., composed of an inert material or a reactant, such as any described herein), defining openings within the scaffold layer(s) (e.g., by plasma etching), and depositing a reactant within the openings (e.g., by atomic layer deposition). In particular embodiments, the method 300 includes providing a scaffold layer 310, depositing 301 a resist layer 315 on a surface of the scaffold layer, and patterning 302 the resist layer to form a patterned resist layer 316 having apertures. Next, a mask layer 320 is deposited 303, in which the pattern of the mask layer 320 is determined by the apertures of the patterned resist layer. Then, the resist is stripped 304 to provide a patterned mask in contact with the scaffold layer, and this mask protects the underlying scaffold material from subsequent etch steps. Next, the masked scaffold layer is etched 305 (e.g., by plasma etching) to form one or more opening (e.g., pores 330) within the scaffold layer. In some instances, this scaffold layer alone is capable of being handled for further fabrication steps. Yet, in other instances, the scaffold layer may be too fragile for handling and, thus, require a support structure to facilitate handling. Thus, the method can optionally include the step of depositing 306 a handle layer 340 on a surface of the etched scaffold layer.

When a handle layer is employed on a front surface, then various fabrication steps can be employed to form complete through-holes within the scaffold layer. In one instance, a back-etch step 307 is conducted, in which the back-side of the scaffold layer is etched to form a scaffold with accessible openings. Then, reactant B 350 is deposited 308 (e.g., by atomic layer deposition) to form a two-dimensional array of ignitable regions (composed of reactant B) supported by the handle layer. Finally, the handle layer is etched to release 309 the ignitable solid 390. The solid 390, in turn, is composed of a scaffold of reactant A 360 (a first reactant), as well as a plurality of ignitable regions composed of reactant B 350 (a second reactant) and arrayed within the scaffold.

Figure 4:
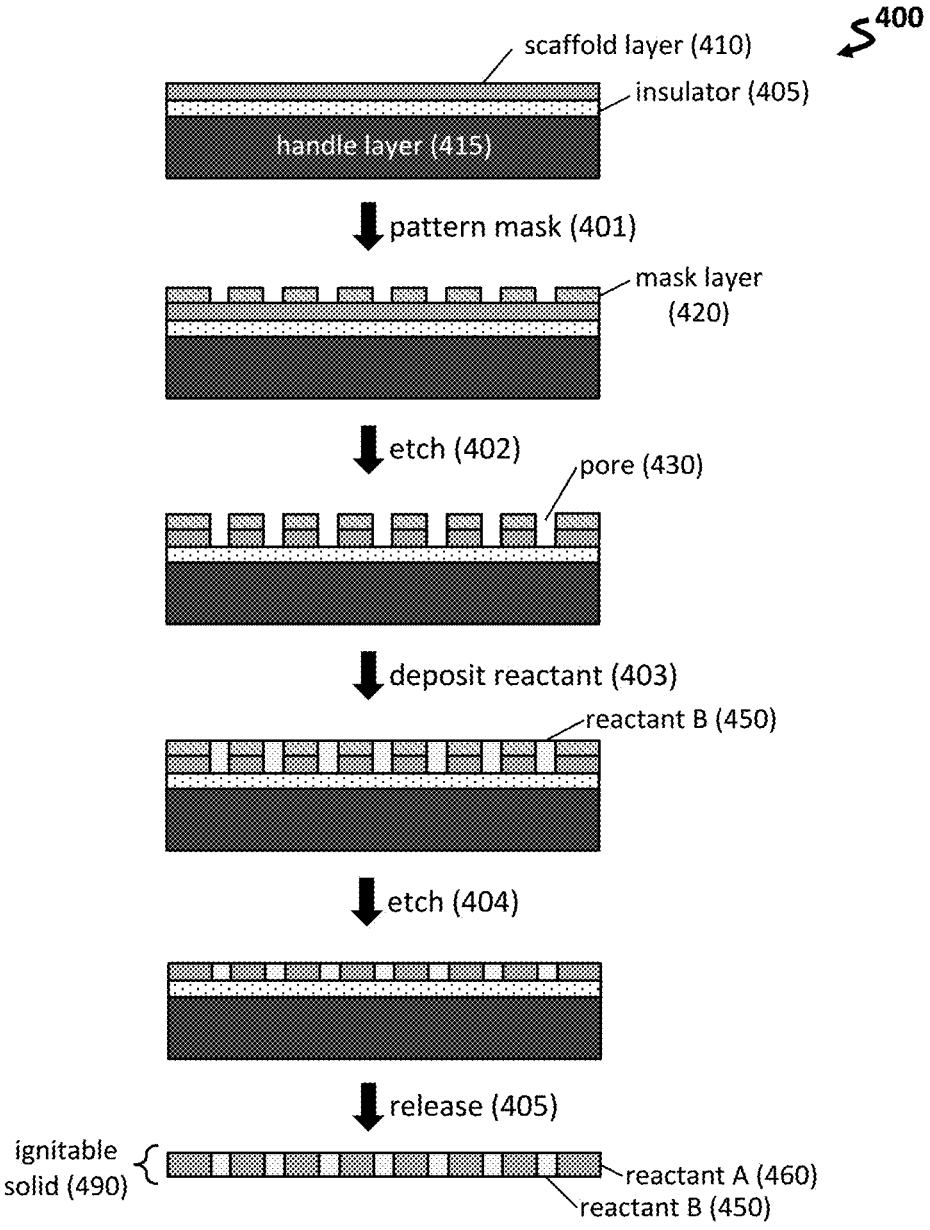
FIG. 4 shows another exemplary method 400 for forming an ignitable solid 490 formed of two reactants 450,460.

Alternatively, the ignitable solid can be fabricated with a substrate including an insulator. FIG. 4 shows an exemplary method 400 of fabricating a two-dimensional solid including two materials, e.g., a first reactant and a second reactant, and employing a silicon-on-insulator (SOI) substrate.

In particular embodiments, the method 400 includes providing a substrate including a scaffold layer 410 (e.g., a silicon device layer), a handle layer 415 (e.g., a thick silicon handle layer), and an insulator 405 (e.g., an oxide, such as a silicon oxide) disposed between the scaffold and handle layers 410,415. Next, a mask layer 420 is deposited 401 having pattern of apertures. Then, masked scaffold layer is etched 402 (e.g., by plasma etching) to form one or more opening (e.g., pores 430) within the scaffold layer.

Reactant B 450 is deposited 403 (e.g., by atomic layer deposition) to form a two-dimensional array of ignitable regions (composed of reactant B) supported by the handle layer. The mask layer is etched 404, and the stack is optionally planarized (e.g., to from a uniform, planar surface of the stack, such as by etching or abrading the surface, thereby removing a portion of a deposited reactant). Finally, the handle layer is etched to release 405 the ignitable solid 490. The solid 490, in turn, is composed of a scaffold of reactant A 460 (a first reactant), as well as a plurality of ignitable regions composed of reactant B 450 (a second reactant) and arrayed within the scaffold.

In another embodiment, a method used to fabricate an ignitable, heterogeneous solid having a two- or three-dimensionally periodic or aperiodic reactant arrays includes a two-step, top-down process, in which openings are created in a bulk scaffold and said openings are subsequently filled with one or more reactants. The scaffold may ultimately participate in the reaction as one of the two reactants or it may be inert. Openings can be made by various subtractive techniques. With reactant spacing set to any useful dimension (e.g., about 5 μm or less, such as to minimize reactant diffusion distances), openings can be made by sputtering, etching, or ablating the scaffold. In one example, a focused or unfocused beam of ions or neutral particles can be positioned across a surface of the scaffold to remove material from selected sites. Focused laser light can, alternatively, ablate material to form openings or stimulate the formation of volatile etch products. In one instance, material removal can involve a mask for feature definition over large areas. Exemplary methods that involve masking are depicted in FIGS. 3 and 4.

Figure 5:
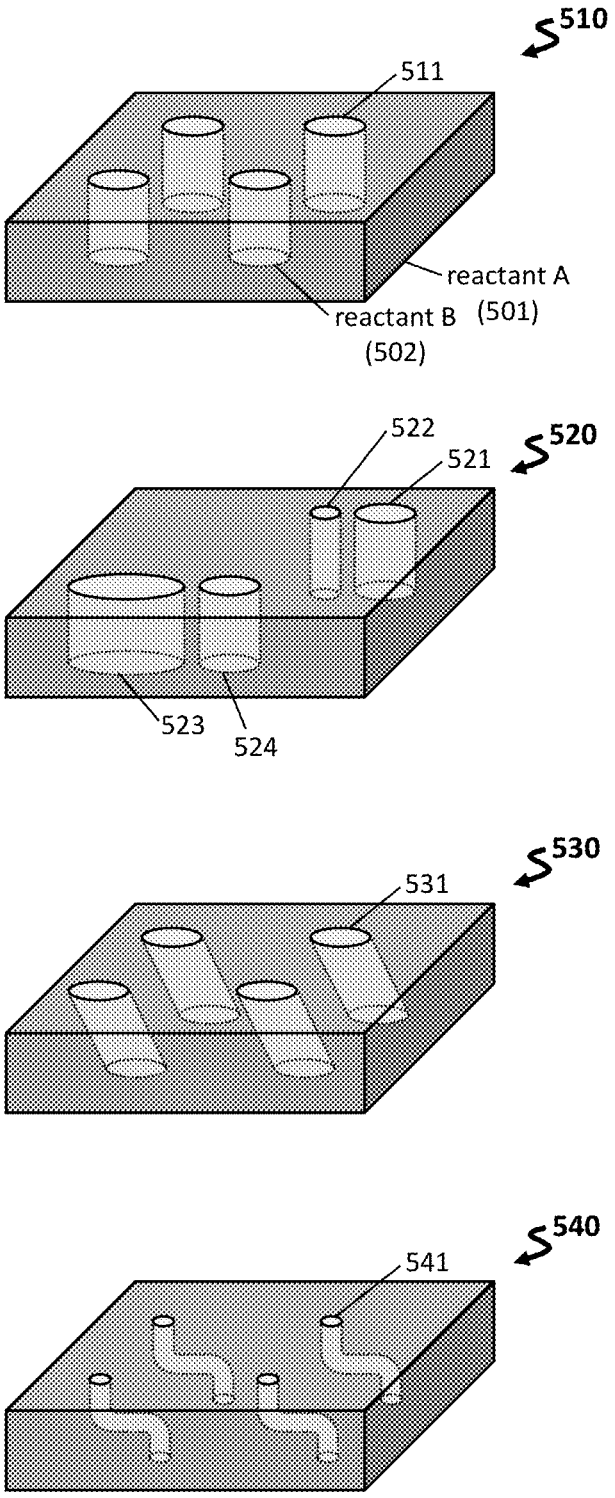
FIG. 5 shows exemplary ignitable solids including pores. Provided are (A) an exemplary ignitable solid 510 including a reactant 502 disposed within a pore 511; (B) another exemplary ignitable solid 520 including a reactant disposed within pores of non-uniform geometry 521-524; (C) yet another exemplary ignitable solid 530 including a reactant disposed within pores having a tilted geometry 531; and (D) another exemplary ignitable solid 540 including a reactant disposed within pores having a meandering geometry 541.

The openings can be arranged in different geometries, as well as include any useful dimension. Exemplary ignitable solids are described in FIG. 5. In one instance, the ignitable solid 510 includes a plurality of ignitable regions 511 disposed within a scaffold. The scaffold is composed of a first reactant (reactant A 501), and the ignitable region is composed of a second reactant (reactant B 502). In another instance, the ignitable solid 520 includes a plurality of ignitable regions 521,522,523,524 having different geometries. Each region can have a useful dimension, such as different radii for each ignitable region (e.g., compare the radius of a first ignitable region 521/523, which is larger than a radius of a second ignitable region 522/524). In addition, each region can be arranged in any useful geometry, such as a pair of regions 521,522/523,524 arrayed in a manner to initiate a particular spatial reaction rate (e.g., a particular rate of reaction, such as a concentration per time; a particular propagation speed, such as distance per time (e.g., m/s or cm/s); or a particular spatial profile, such as concentration per time per area). In one instance, the ignitable solid 530 include ignitable regions 531 having a tilted hole geometry, which can be defined using a directed beam. In yet another instance, more complex designs including meandering openings 541 can be achieved for the ignitable solid 540. Additional geometries are described herein, such as in FIG. 6A, 6B, or 7. One method for creating complex arrays of meandering openings in a solid is a bottom-up approach involving additive fabrication. Material could be built layer-by-layer to establish complex opening designs. Again, the scaffold built by additive machining could be inert or, alternatively, reactive, thereby participating in the propagating chemical reaction when ignited.

Figure 6A:
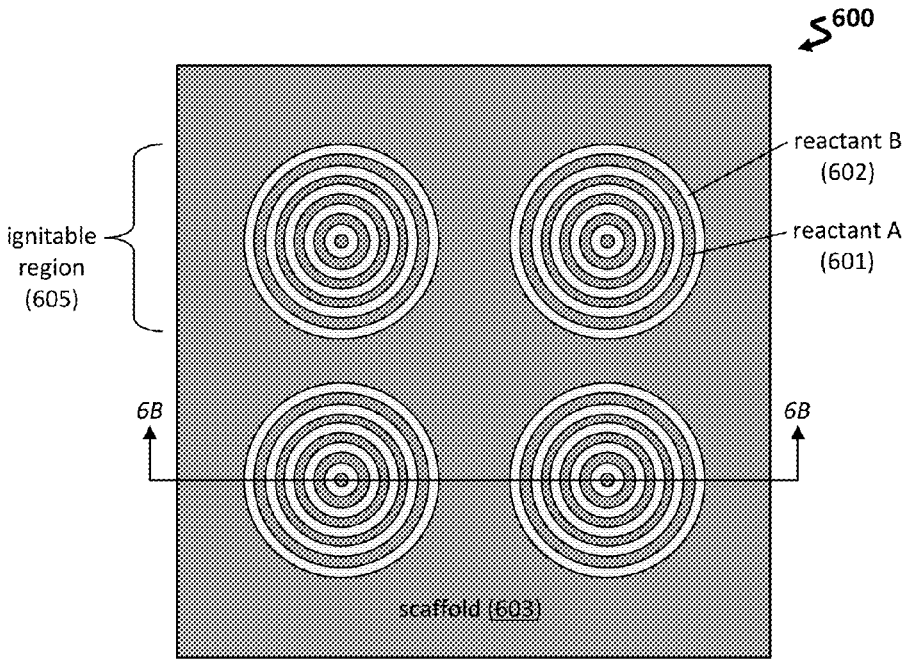
FIG. 6A-6B shows an exemplary ignitable solid 600 including a scaffold 603 having an array of pores, in which each pore includes an ignitable region 605. Provided are (A) a plan view of the composition and (B) a cross-sectional view along line 6B-6B showing an ignitable region 605 including an arrangement of reactants A and B 601,602.
Figure 6B:
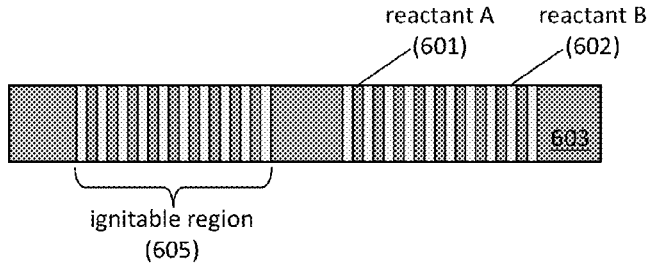

Each opening, itself, can include an array (or a multilayer) of reactants. For instance, each opening can include a circumferentially-stratified arrangement of reactant A and reactant B in any useful arrangement (e.g., an alternating A/B/A/B . . . arrangement). Each reactant within the opening can be reactive. Alternatively, one of the reactants can be inert. FIG. 6A-6B shows an exemplary ignitable solid 600, which includes a scaffold 603 having a plurality of openings. Each opening defines an ignitable region 605. Furthermore, each region 605 includes an array of reactants, such as a circumferentially-stratified arrangement of reactant A 601 and reactant B 602. Both reactants A and B can be reactive, or reactant B can be reactive and reactant A is inert. The width of each deposited reactant layer can be tuned for optimal reaction properties.

Once openings are defined in a solid, these can be filled with one or more reactants to create an ignitable, heterogeneous solid. Methods for filling openings include any useful technique, such as chemical vapor deposition and/or atomic layer deposition. The additional reactant material could infiltrate openings to completely fill or partially fill the solid. Chemical vapor deposition (CVD) traditionally involves elevated temperatures to stimulate decomposition of a precursor molecule on a growth surface. For CVD to be used for the deposition of reactant material in openings to form an ignitable solid, the growth temperature should be ~250° C. or less, depending on the reactive system. Otherwise, vapor deposition can be accompanied by partial or complete mixing of the reactants prior to the end of the process, which can significantly decrease the stored chemical energy of the solid.

Reactants can be deposited in openings in any useful manner. Exemplary techniques include physical vapor deposition, chemical vapor deposition (CVD), atomic layer deposition (ALD), sputter deposition, electron-beam deposition, etc., such as those techniques described in Aaltonen T et al., "Atomic layer deposition of platinum thin films," *Chem. Mater.* 2003; 15(9):1924-8 and Adams D P, "Reactive multilayers fabricated by vapor deposition: a critical review," *Thin Solid Films* 2015; 576:98-128, each of which is incorporated herein by reference in its entirety.

Atomic layer deposition is an additive vapor deposition method that can be used for low temperature, conformal deposition of reactant materials. A material is deposited as a layer through sequential self-limited steps (called half reactions, see, e.g., FIG. 13), keeping the precursor materials separate during the half reactions. ALD has been used to deposit metals or metal oxides, including W, Pt, Ir, Pd, Ag, Ta, Ni, Co, Er, NiO, $Co_3O_4$, MnO, $WO_3$, $SnO_2$, $Bi_2O_3$, and $Ta_2O_3$. Such metal and metal oxides could find use as a reactant when combined in unique ways. ALD processes provide excellent film thickness uniformity, especially when coating an opening having a high aspect ratio. In some instances, ALD is employed for growing reactants into a through-via contained on a substrate. Openings may be completely or partially filled by ALD by limiting the number of chemical steps. Partially filled openings may be useful for further tailoring reaction speeds to desirable low values.

A single reactant material may be deposited into the openings created in a scaffold substrate to produce an ignitable, energetic solid if the substrate is also a reactant. An example of this includes the deposition of Ni, Pt, or Co (or alloys thereof) into a porous Si substrate, in which the deposited metal reacts with Si when ignited or stimulated. Any useful metal can be deposited, including those metals that react exothermally with the material of the scaffold (e.g., in which reactants A and B, or the first and second reactants as described herein, results in an exothermic reaction). In some embodiments, the reactant is a metal that reacts exothermically with Si.

In one example, the ignitable solid includes an array of Pt ignitable regions disposed in a Si scaffold with a reactant periodicity of less than 1 μm. The solid can be ignited with reactants held at room temperature prior to reaction. Once ignited, the Pt and Si phases mix across interfaces, and the heat produced from reaction transports into neighboring, unreacted volumes to start reactions anew. Alternatively, thermites could be produced by the atomic layer deposition of a metal oxide (e.g., $WO_3$, $SnO_2$, or $Bi_2O_3$) into the openings of a Si scaffold. Each of these metal oxides undergoes a large exothermicity, reduction-oxidation reaction with Si.

Figure 7:
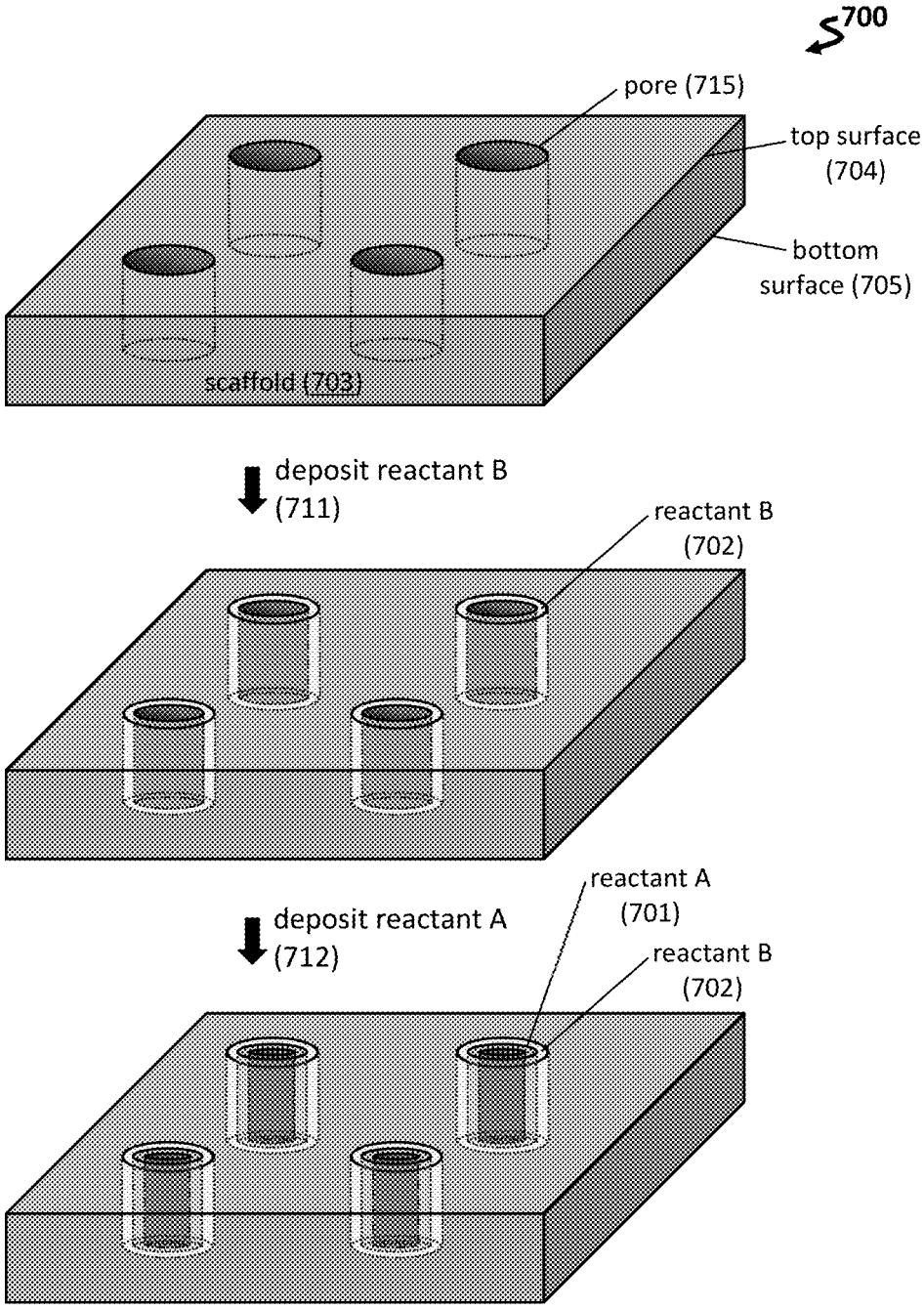
FIG. 7 shows an exemplary method 700 for forming an ignitable solid having a multilayer of reactants 701,702 disposed within each pore 715.

In addition, deposition techniques (e.g., ALD) may be utilized to deposit multiple reactants into openings to have a circumferentially-stratified structure, e.g., as shown in FIG. 6A, 6B, or 7. Deposition involving two different materials can be completed sequentially. Unlike previous methods involving sputtering and evaporative deposition, ALD can produce a well-defined, uniform, stratified multilayer structure within obscured openings (i.e., those that do not have direct line of sight to the vapor source). For example, circumferentially stratified, metal-metal, ignitable multilayers can be deposited in one or more openings by ALD. Metal-metal oxide multilayers (e.g., a layer of Ta that alternates with a layer of $WO_3$) can also be deposited in a similar manner. The construction of two or more reactive species (reactants) within one or more openings means that the reaction does not necessarily rely on reaction with the neighboring substrate or base material. Indeed, the substrate may be inert to the reaction.

Figure 8:
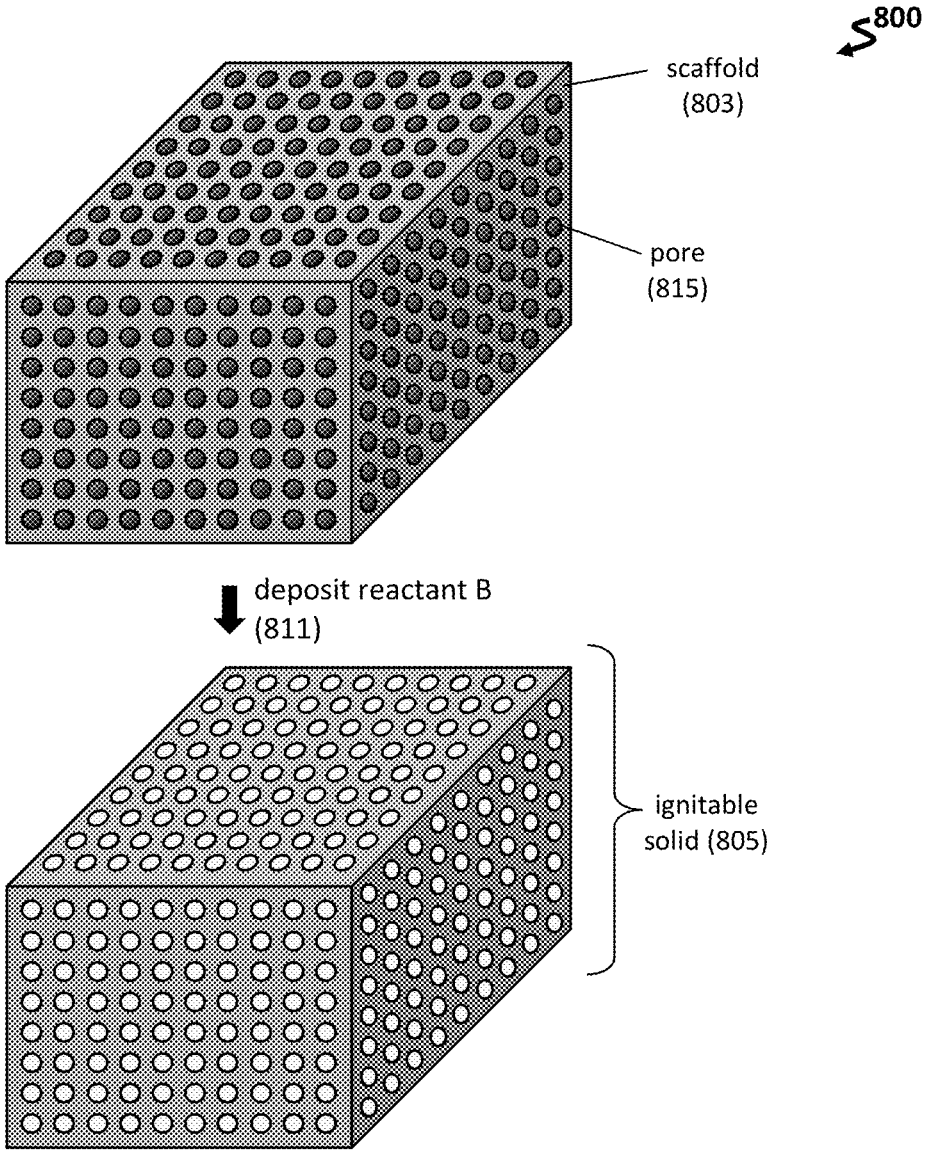
FIG. 8 shows an exemplary method 800 for forming an ignitable solid 805 having a reactant disposed within each pore 815.

FIG. 7 shows an exemplary method 700 for forming a multilayer of reactants within an opening. The initial scaffold 703 includes a plurality of openings (pores 715) and has a top and bottom surface 704,705. A first reactant (reactant B 702) is deposited 711 within the scaffold. Then, a second reactant (reactant A 701) is deposited 712 upon the pre-deposited layer of the first reactant. These two steps 711,712 can be conducted in an alternating matter to form a multi-layered pattern of reactants (e.g., reactant B/A/B/A etc. layers) within the opening. FIG. 8 shows a method 800 of fabricating an ignitable solid 805 by depositing 811 reactant B within openings (pores 815) defined within the scaffold 803.

To date, ignitable solids have been manufactured by a few processes. Particle compacts, which are a roughly three-dimensional, semi-periodic arrangement of reactants, have been made by mixing, blending, or pressing. Small reactant spacings (e.g., about 1 μm) are achievable with these methods owing to the size of the initial particles that are mixed. Although blended, these methods do not guarantee a periodic array of reactants. This can be limiting when formed as a thin sheet or other small volume as the material may not fully propagate a reaction. On the other hand, well-defined, stratified heterogeneous foils or films having a one-dimensionally periodic arrangement of reactants with nanometer periodicity exhibit reliable reactions. Rolling has been implemented for layering individual reactant foils into a single, ignitable, stratified form. The individual reactant foils are stacked in a sequence (e.g., typically A/B/A/B, where A and B are dissimilar materials) and then bonded. The individual layer thicknesses of this composite material are tailored by repeated rolling until desired dimensions are achieved. This method has recently been used in the production of reactive, ignitable Ni/Al foils by Knepper R et al., "Effect of varying bilayer spacing distribution on reaction heat and velocity in reactive Al/Ni multilayers," *J. Appl. Phys.* 2009; 105:083504 (9 pp.), which is incorporated herein by reference in its entirety.

Additional techniques including physical vapor deposition have been utilized for constructing one-dimensionally periodic, stratified structures (multilayers) with nanometer- to micrometer-size periodicity. Ignitable multilayers comprised of dissimilar metals and metal-metal oxide pairs have been fabricated by vapor techniques involving sputter deposition or electron beam evaporation. For these techniques, a substrate is generally alternately moved to two operating vapor sources to build microstructures, generally having an A/B/A/B sequence, where A and B are dissimilar reactants. More complex stacking sequences (e.g., A/A/B/A/B/A/A) are possible with these additive techniques as demonstrated by Knepper R et al., "Effect of varying bilayer spacing distribution on reaction heat and velocity in reactive Al/Ni multilayers," *J. Appl. Phys.* 2009; 105:083504 (9 pp.), which is incorporated herein by reference in its entirety, but again produced structures are one-dimensionally periodic. Extensions of these deposition techniques access a few nonplanar geometries. For example, Weihs et al. deform the stratified solid into a nonplanar shape prior to ignition, see, e.g., U.S. Pat. Nos. 6,534,194, 6,596,101, and 7,143,568, as well as U.S. Pat. Pub. No. 2009/0178741, each of which is incorporated herein by reference in its entirety. Multilayers may also be removed from substrates after their construction for use as ignitable foils. Sputter deposition and/or electron beam evaporation methods are restricted to direct line of sight geometries for deposition, making deposition into obscured openings impossible.

Design of Ignitable Regions

Characteristics of the ignitable solid can be controlled by optimizing one or more dimensions (e.g., of the opening, scaffold, ignitable region, layer of a reactant, etc.) and one or more chemical materials (e.g., of the reactant, scaffold, inert material, etc.). In one instance, the reactant within the ignitable region and the material of the scaffold are selected from a reactant combination (e.g., any described herein) that undergoes an exothermic reaction (e.g., characterized by production of heat that is of a high temperature, a uniform production, and/or a rapid heating). In another instance, a first reactant and a second reactant, both within an ignitable region, are selected from a reactant combination that undergoes an exothermic reaction (e.g., any described herein).

Each ignitable region can be arranged within the solid in any useful manner. In one instance, a first ignitable region is located in proximity to a second ignitable region, where the distance between the regions allows for a particular reaction rate.

Controlling dimensionality of reactants in a heterogeneous reactive material is crucial to controlling the behavior of the reaction. Currently, reactant layer thickness can be generally controlled for powder systems through ball-milling or precisely controlled by sputter deposition in thin films in order to tailor the overall reaction behavior. However, neither method allows for anything more than global control of the reaction propagation rate. In contrast, ALD is a controllable technique that is useful creating heterogeneous reactive materials. This method not only allows precise control of reactant periodicity, but also allows geographic control of that periodicity. Although constant spacings between openings can be employed, ALD techniques lend itself to controlled spatial variation of reactant periodicity to create a tailored distribution of reaction propagation rates over the area of the thin film. The openings can be arranged in different geometries in any useful manner.

In one instance, the ignitable solid is configured to provide increased flexibility of high-density, thin reactive materials. The scaffold can be formed from an appropriate material and/or of an appropriate thickness that provides a pliable solid (e.g., having a low internal stress and/or low brittleness). In another instance, the solid has increased scalability of production. In yet another instance, the solid has a viewable periodicity. For example, the orientation of periodicity and direction of the reaction at discrete interfaces allow facile viewing of the reaction (e.g., FIG. 10A). More complex designs of ignitable regions can be achieved, such as meandering openings (see, e.g., FIG. 5). In some instances, the scaffold is a monolithic substrate, which itself is composed of a reactive reactant.

Ignition Points and Delay Lines

The ignitable solid can be ignited in any useful manner. Ignition at a point can begin the reaction within the solid. Various means, including focused laser, hot probes, electrostatic discharge, hot particles and mechanical impact, have been used successfully to ignite these materials.

Optionally, one or more delay lines can be ignited in any useful manner to initiate the reaction. Such point ignition mechanisms can include an electrical ignition mechanism (e.g., by way of applying an electrical discharge or localized direct current heating), a mechanical ignition mechanism (e.g., by way of applying a mechanical impact at the ignition site), and/or a laser ignition mechanism (e.g., by way of applying a focused laser light).

Figure 9A:
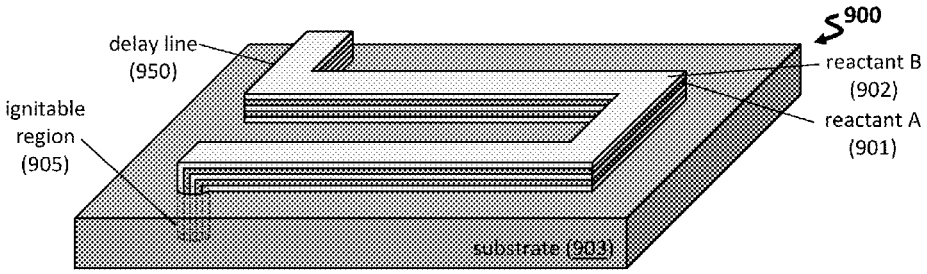
FIG. 9A-9B shows exemplary assemblies including an ignitable solid. Provided are (A) an exemplary assembly 900 including an ignitable region 905 and a delay line 950; and (B) another exemplary assembly 9000 including ignitable vias 9005,9025, delay lines 9051,9052, and an underlying ignitable solid 9500.

A layered reactant structure deposited within at least one opening can be sufficient to propagate a reaction from one surface of the substrate to another. For example, this could be of utility for increasing the path length of a delay line. As depicted in FIG. 9A, an ignitable region 905 (e.g., an ALD-filled via) may continue the reaction from one surface of the scaffold 903 to another side of the scaffold 903, where it encounters a long-path length, reactive delay line 950. The delay line can include a multilayered stack having a first reactant (reactant A 901) and a second reactant (reactant B 902). Multiple stacked substrates, each having a meandering line and a reactive via may be stacked to achieve a compact volume, long-path length microscopic fuse.

Figure 9B:
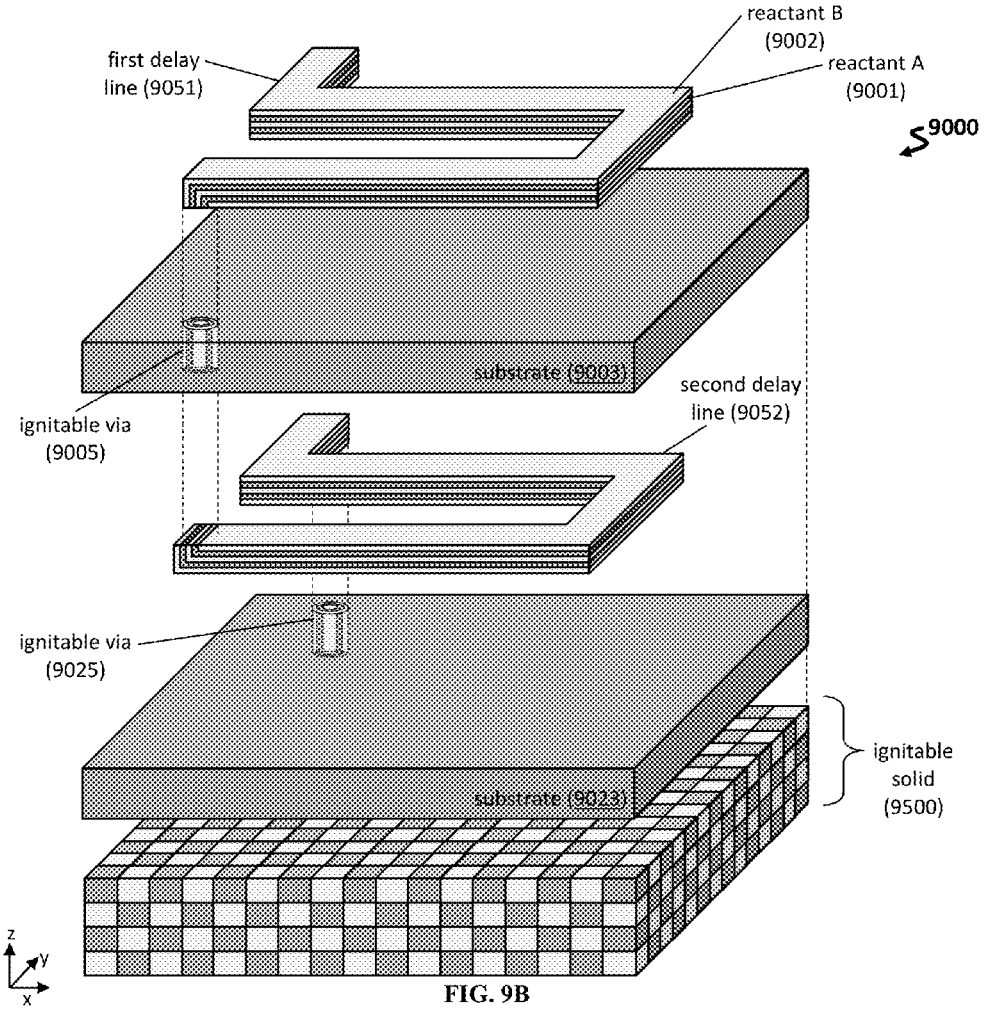

The present invention also includes an assembly including any ignitable solid, ignitable region, scaffold, and/or delay line described herein. FIG. 9B shows one exemplary assembly 9000 including an ignitable solid 9500. Ignition of the solid can include one or more substrates to spatially arrange one or more delay lines in order to control the reaction. In one instance, the assembly includes an ignitable solid underlying a stack of substrates 9023,9003 and delay lines 9051, 9052, which are connected by way of ignitable vias 9005,

9025. Optionally, the substrate is formed from an inert material to spatially isolate the delay lines from the ignitable solid. The substrate can include one or more through-vias, which include one or more reactant(s) facilitating ignition. For instance, each of the ignitable vias 9005,9025, delay lines 9051,9052, and/or the ignitable solid 9500 is composed of a first reactant (reactant A 9001) and a second reactant (reactant B 9002).

The delay line can have any useful geometry. The delay line can have an extended length and/or a meandering or serpentine structure (e.g., to provide an extended length along a planar surface of the substrate). Each delay line can be disposed on a substrate (e.g., a substrate composed of an inert material). Connection between ignitable materials can include the use of one or more through-vias disposed within the substrate, and one or more delay lines can be connected or in proximity to one or more through-vias.

Reactants

Ignitable solids can rapidly evolve heat, which in turn can drive a self-propagating chemical reaction within the solid that partially or completely mixes all of the reactants. After ignition of the ignitable solid, the heat released solely from the mixing of the included reactants, can drive a rapid, high temperature reaction forward. Reactions can be completed in air, other gaseous environments, or vacuum.

Two general types of propagating chemical reactions are known. Deflagration reactions are characterized by a propagating reaction wave that travels at a speed less than the speed of sound in the ignitable solid. Detonation reactions are described by a propagating reaction wave that travels at a speed greater than the speed of sound in the ignitable solid. Reactions may involve the evolution of gas or may remain gasless.

A variety of ignitable, heterogeneous compositions have been identified previously. This includes different metal-metal mixtures that react to form intermetallic compounds. Metal-metal oxide mixtures undergo reduction-oxidation reactions and release heat in what is referred to as a thermite reaction. Other forms of heterogeneous, ignitable solids include metal-polymer, metal-metal sulfide, and metal-metal hydride mixtures. Much like thermites that exhibit reduction-oxidation reactions, these latter mixtures react the metal with one or more species (e.g., sulfur) initially contained in the other substance (e.g., sulfide). This could involve reduction-sulfurization or reduction-nitridation reactions.

The ignitable solid can include any useful reactant (e.g., a reactant configured to undergo and/or propagate an exothermic reaction). Exemplary reactants include one or more of the following: an organic (e.g., carbon (C)), a metalloid (e.g., boron (B) or silicon (Si)), a transition metal (e.g., scandium (Sc), yttrium (Y), titanium (Ti), zirconium (Zr), vanadium (V), niobium (Nb), tantalum (Ta), tungsten (W), iron (Fe), ruthenium (Ru), cobalt (Co), rhodium (Rh), iridium (Ir), nickel (Ni), palladium (Pd), platinum (Pt), copper (Cu), silver (Ag), gold (Au), and/or aluminum (Al)), an alkaline (e.g., magnesium (Mg)), a metal oxide (e.g., $M_xO_y$, where M is a metal, x is an integer of from about 1 to 5, and y is an integer of from about 1 to 5), a lanthanoid (e.g., Er), and/or a fluorocarbon.

Two or more of these reactants can be employed as a reactant combination. Exemplary combinations include silicon (Si) with a transition metal or a lanthanoid (e.g., W, Pt, Ir, Pd, Ag, Ta, Ni, Co, and/or Er) or a metal oxide (e.g., $Ta_2O_3$, $WO_3$, MnO, $Fe_2O_3$, $Co_3O_4$, NiO, CuO, $SnO_2$, and/or $Bi_2O_3$); carbon (C) with a transition metal (e.g., W, Pd, and/or Ta); a fluorocarbon with a transition metal (e.g., W, Pt, and/or Ir); aluminum (Al) with a transition metal (e.g., Ni, Co, Pt, and/or Pd) or a metal oxide (e.g., $Ta_2O_3$, $WO_3$, MnO, $Co_3O_4$, NiO, $SnO_2$, and/or $Bi_2O_3$); and/or a silicon, carbon, or fluorocarbon with W.

Other exemplary reactant combinations include those to form an aluminide, such as a combination of Al with Co, Ni, Pd, Pt, Ru, Ti, and/or Zr, as well as alloys including any of these, such as a Ni—Cr alloy (e.g., an Inconel alloy), a Ni—Cu alloy (e.g., a Monel alloy), or a Ni—V alloy; to form a boride, such as a combination of B with Ti; to form a carbide, such as a combination of C with Ti; to form a silicide, such as a combination of Si with Nb, Ni, Rh, Ti, V, and/or Zr; to form a titanide, such as a combination of Ti with Ni; to form a zirconide, such as a combination of Zr with Ni or an alloy thereof, such as a Ni—V alloy; to form a bimetal, such as a combination of Ag with Sc and/or Y, a combination of Au with Sc and/or Y, or a combination of Cu with Sc and/or Y; to form a thermite, such as a combination of a metal oxide with Al, where exemplary metal oxides include copper oxide (e.g., $Cu_xO_y$, such as CuO), cobalt oxide (e.g., $Co_xO_y$, such as $Co_3O_4$), iron oxide (e.g., $Fe_xO_y$, such as $Fe_2O_3$), nickel oxide (e.g., $Ni_xO_y$, such as NiO), or tin oxide (e.g., $Sn_xO_y$, such as $SnO_2$), where x and y is any useful number (e.g., where x is an integer of from 1 to 5 and y is an integer of from 1 to 5); or to form an organic material, such as a fluorocarbon (e.g., a perfluorocarbon) with Mg.

In particular embodiments, the reactants are selected from a reactant combination. Exemplary reactant combinations include those having Au, such as Au with Sc and/or Y; those having Ag, such as Ag with Sc and/or Y; those having Cu, such as Cu with Sc and/or Y; those having aluminum, such as Al with Pt, Pd, Ni, Zr, Cu, and/or Co, or an alloy including one or more of these; those having titanium, such as Ti with B, Ni, Al, and/or C; those having nickel, such as Ni with Zr; those having silicon, such as Si with Nb and/or Ni; etc. In some embodiments, the reactant combination is selected from a combination of reactants exhibiting a high change in enthalpy, exhibiting a steady propagating reaction, and/or exhibiting an exothermic reaction.

Additional reactants are described in Adams D P et al., "Exothermic reactions in Co/Al nanolaminates," *J. Appl. Phys.* 2008; 104:043502 (7 pp.); Adams D P et al., "Reactive Ni/Ti nanolaminates," *J. Appl. Phys.* 2009; 106:093505 (8 pp.); Barron S C et al., "Self-propagating reactions in Al/Zr multilayers: anomalous dependence of reaction velocity on bilayer thickness," *J. Appl. Phys.* 2013; 114:223517 (10 pp.); Gavens A J et al., "Effect of intermixing on self-propagating exothermic reactions in Al/Ni nanolaminate foils," *J. Appl. Phys.* 2000; 87:1255-63; Reeves R V et al., "Reaction instabilities in Co/Al nanolaminates due to chemical kinetics variation over micron-scales," *J. Appl. Phys.* 2014; 115:044911 (10 pp.); Reeves R V et al., "Condensed-phase and oxidation reaction behavior of Ti/2B foils in varied gaseous environments," *J. Phys. Chem. C* 2012; 116:17904-12; Adams D P, "Reactive multilayers fabricated by vapor deposition: a critical review," *Thin Solid Films* 2015; 576:98-128; and Miikkulainen V et al., "Crystallinity of inorganic films grown by atomic layer deposition: overview and general trends," *J. Appl. Phys.* 2013; 113:021301 (101 pp.), as well as U.S. Pat. Nos. 5,505,799, 5,538,795, 5,547,715, 6,149,785, 7,829,157, 7,951,247, 8,187,398, 8,227,297, 8,299,630, 8,328,967, and 8,431,197, and U.S. Pat. Pub. No. 2013/0330567, each of which is incorporated herein by reference in its entirety.

The scaffold can include a reactive reactant and/or an inert reactant. In some embodiments, the scaffold includes silicon, carbon, aluminum, or fluorocarbon (e.g., a perfluorocarbon, a fluoropolymer, a perfluoropolymer, or $(C_xH_yF_z)_n$, where x is of from about 1 to 10, y is of from about 0 to 24, z is of from about 1 to about 24, and n is any useful integer, such as of from about 1 to 1000). In other embodiments, the scaffold is a three-dimensional carbon or silicon scaffold. Three-dimensional scaffolds can be made in any useful manner, such as interferometric lithography, immersion lithography, nano-imprint lithography, membrane projection lithography, or electron-beam lithography.

In addition, reactant(s) can be deposited on and/or within scaffolds in any useful manner, such as atomic layer deposition, electrochemical deposition, electron-beam evaporation, sputter deposition, etc. Additional scaffolds and related methods are described in Burckel D B et al., "Lithographically defined porous carbon electrodes," *small* 2009 December; 5(24):2792-6; Burckel D B et al., "Fabrication of 3D metamaterial resonators using self-aligned membrane projection lithography," *Adv. Mater.* 2010 August; 22(29):3171-5; Xiao X et al., "Lithographically defined three-dimensional graphene structures," *ACS Nano* 2012; 6(4):3573-9; and Zhang H et al., "Three-dimensional metal scaffold supported bicontinuous silicon battery anode," *Nano Lett.* 2012 Jun. 13; 12(6):2778-83, each of which is incorporated herein by reference in its entirety.

Uses

Ignitable solids can rapidly evolve heat, which in turn can drive a self-propagating chemical reaction within the solid that partially or completely mixes all of the reactants. For this reason, ignitable solids are identified for their potential use as fuses, igniters, decoy flares, solders, welds, fusible brazing materials (e.g., joints), metallized inserts, and heat sources, e.g., for joining via soldering, welding, or brazing. Such ignitable solids can be used for soldering, brazing, welding, or joining of subassemblies or packages, including amorphous glasses, metallic glasses, ceramics, or microelectronics. Metallized joints and inserts can be formed between components (e.g., metallized components, metal (e.g., stainless steel) components, polymers, cermet, ceramics, etc.), such as by placing an ignitable solid between components, applying pressure to ignite an ignitable solid, and forming a joined assembly. The ignitable solid can be bent, folded, rolled, or deformed into a non-planar shape prior to ignition.

The ignitable solid can be used to transmit a heat pulse from end of a component to another end of the component. For instance, the heat pulse can be transmitted from a first ignitable solid in order to ignite a second ignitable solid. When the ignitable solid is used as an igniter, it can be located in proximity to a neighboring propellant or energetic material. Other uses are described in U.S. Pat. Nos. 5,538,795, 5,547,715, 6,863,992, 6,875,521, 6,736,942, 8,387,612, and 8,991,387, as well as U.S. Pat. Pub. Nos. 2004/0234699, 2004/0234914, 2004/0234916, 2005/0079166, 2009/0301363, and 2013/0180516, each of which is incorporated herein by reference in its entirety.

In one instance, when ignited, the reactant(s) of the ignitable region/scaffold will undergo a complete or partial phase change. For those materials that remain intact after reaction, the properties of the reaction product can be significantly different compared to the properties of the initial, unreacted composite form. This can be of potential utility. For example, a single crystal Si scaffold containing an arrangement of Pt micron-scale ignitable regions may initially be semi-transparent to infrared radiation. Si is known to be largely transparent at 1064 nm. Upon ignition, Si and Pt react to form a metallic platinum silicide, where this reaction product is opaque to IR radiation. By using such reactants and reaction products, the ignitable solid can be employed as a switchable optic, e.g., for improved beam handling and safety.

EXAMPLES

Example 1: Fabrication of High-Density, Reactive Ignitable Solid with Nanometric Periodicity Reactive materials with small-scale periodicity find utility in various research areas and components, like joining processes. A typical form factor for these materials is a multilayer thin film with nanometric periodicity. These multilayers are made by depositing alternating layers of reactive metals onto a planar substrate, thereby producing a stack with nanometric layers and 1-D periodicity in the stacking direction. Weaknesses of this approach are brittleness of the deposited foils and the high cost and difficulty of scaling the process. Here, we propose to create a reactive composite material by filling the pores in a thin, flexible Si substrate 2-D periodic pore structures with a metal using Atomic Layer Deposition (ALD). Using these processes, the method will be likely be scalable with general application to various porous substrates, while providing for enhanced study of the reactive interfaces.

From a research standpoint, the geometry of the foils ultimately limits their utility. In general, the 1-dimensional periodicity and high purity reactants for nanolaminates are preferred in a research capacity over powder compacts. Powder compacts have random 3-dimensional periodicity and much higher levels of impurities. However, nanolaminates still have a significant weakness in that the reactant periodicity is unable to be directly viewed. As such, any conclusions that can be reached about the reaction kinetics at the length scales of the individual reactants must be inferred from measuring bulk properties, such as reaction propagation rate, flame temperature, apparent activation energy, etc. This requirement leaves significant uncertainty with any conclusion of reaction kinetics during self-propagating reactions.

The sputter-deposition method is also limiting, from a production standpoint. Sputter-deposition is a serial process, so increased throughput can be achieved by increasing the sputtered area, usually by using larger systems or by increasing the number of sputter guns. Both methods of increasing production throughput are costly and have significant implementation difficulties.

Here, five micrometer thick, nanometrically-porous Si substrates were produced using semiconductor fabrication techniques. The target materials included single-crystal Si substrates with patterned porosity. The porosity was created by Bosch etching and consisted of regularly spaced pores with diameters of 250 nm, 500 nm, or 1000 nm. Each test sample contained pores of a single diameter. The pores were coated with Pt using ALD, which was shown to be successful in producing a composite material consisting of unreacted Si and Pt. A revised etching process to result in free-standing reactive foils is also described herein.

In order to exploit the strengths of thin-film, heterogeneous reactive materials and mitigate their weaknesses, we created thin, flexible, nanometrically-periodic, heterogeneous reactive materials with 2-dimensional spatial control. The general strategy for producing these materials was to create a thin, porous substrate of one commonly used reactant using well-known, scalable processes, and then to backfill the pores through a chemical vapor deposition process with a second reactant. In this way, the flexibility of the original substrate can be retained and exploited. The orientation of the reactant periodicity of the pores can also be closely controlled and arranged for direct viewing.

Figure 10A:
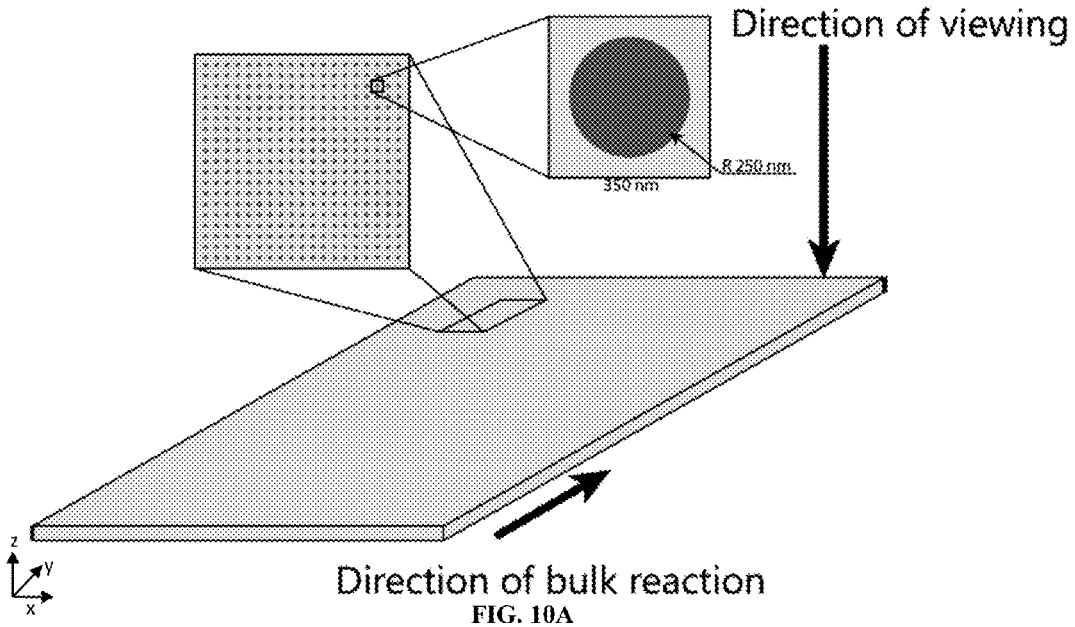
FIG. 10A-10B shows schematics of a two-dimensional ignitable solid having periodic reactive structures. Provided are (A) a perspective view of the ignitable solid, in which the orientation of the periodicity allows direct viewing of the reactive interface in the bulk materials and in which the scale of the periodicity is on a nanoscale; and (B) a plan view of an ignitable region within the ignitable solid, in which the reactants are configured to undergo an exothermic reaction (e.g., having an change in enthalpy of formation of less than 0).
Figure 10B:
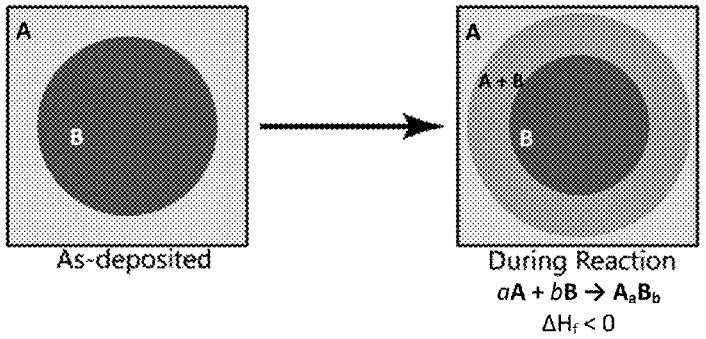

A representative drawing of the ignitable solid is shown in FIG. 10A-10B. The solid includes an array of ignitable regions, which allow for a direction of viewing (along the z-axis) that is orthogonal to a direction of the bulk reaction between ignitable regions (along the y-axis). In the as-deposited ignitable solid, the ignitable region includes a first reactant (reactant B in FIG. 10B) disposed with a second reactant (reactant A). Upon ignition, an exothermic reaction initiates at the interface between reactant A and reactant B, and the resulting reaction product (A+B) form at this interface. As the reaction proceeds (between the A/B interface), additional product is formed.

The ignitable solid was fabricated differently from the previous multilayer approach, which involves deposition of both reactants. In the method herein, one of the reactants (Si) was present initially in the form of a porous substrate. In contrast to other deposition methods, ALD allows for low-temperature conformal coating of the pore walls and the subsequent filling of pores. Both characteristics are important; low-temperatures prevent atomic mixing of the reactants, while conformal coating ensures good interfacial characteristics between the reactants.

The resulting structure can allow for many unique applications and first-of-their-kind studies. Due to the native characteristics of the thin single-crystal Si, possible applications may include flexible reactive materials leading to conformal heat sources, as well as switchable optics. From a research perspective, the ability to directly image reaction fronts for kinetics, study effects of doping on reactive behavior including in-situ, and fundamental studies on the mechanisms of reactions can provide information that has never before been available. Such methods and ignitable solids can create additional energetic Si-based reactive materials, including thermites, which are accessible through ALD on Si.

Material Production and Process Development

The creation of the 2-dimensionally periodic, heterogeneous reactive materials was performed in two major steps. First, the porous substrate was created from Si wafers using semiconductor fabrication techniques. Then, Pt was deposited through ALD to create a reactive pairing with the Si substrate. This 2-step approach, as well as specific process adaptations that occurred during the duration of the study, are described herein.

A reactive combination of Si and Pt was selected as the starting point for generating the new material. As a reactive pair, Si/Pt has similar heat release to the widely studied Ni/Al reactive system:

$$Ni+Al \rightarrow NiAl,\ \Delta H_f = -58\ kJ/mol_{atoms});\ \text{and} \quad \text{(Eq. 1a)}$$

$$Si+2Pt \rightarrow SiPt_2,\ \Delta H_f = -62\ kJ/mol_{atoms}). \quad \text{(Eq. 1b)}$$

To verify that thin films of Si/Pt reacted in a self-propagating fashion, nanolaminates of Si/Pt with bilayer (BL) thicknesses of 400 to 750 nm were grown and reacted as freestanding foils. The reaction propagation rates of these foils were 7.29±0.06 m/s for the 400 nm BL foil and 4.09±0.02 m/s for the 750 nm BL foil. This was very similar behavior to other nanolaminate systems. These results also gave confidence that Si/Pt structures can react at the periodicities of interest, and they can do so with performance similar to current commercial products.

Reaction behavior was not the only consideration when selecting the Si/Pt system; the other weaknesses of nanolaminates needed to be addressed. It is known that thin, single crystal Si, such as the device Si found on commercial silicon-on-insulator (SOI) wafers, is very flexible when removed from the substrate. If this flexibility could be retained after pore creation and Pt deposition, the brittleness issues associated with traditional nanolaminates could be mitigated. The selection of Si as the host material also allowed for processing of the wafers using well-established lithographic and etching techniques familiar to semiconductor fabricators. This lends itself to scalable production, as well as providing precise control over pore arrangement and size.

Figure 11:
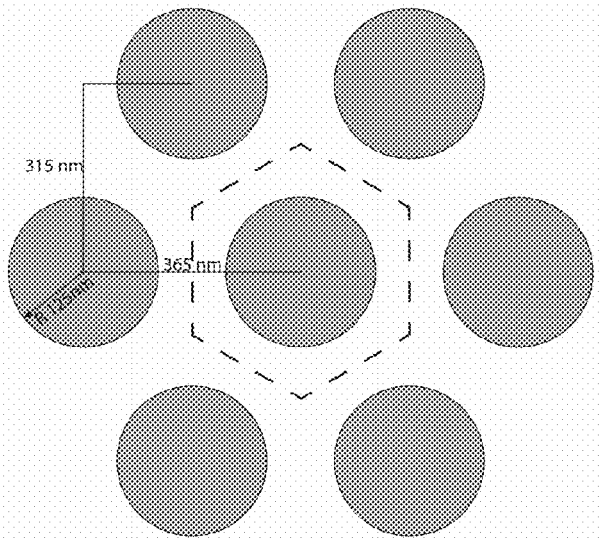
FIG. 11 shows a schematic of an exemplary design to create 250 nm pores in a silicon (Si) wafer. The dashed line represents the approximate size of the chemical cell around each pore. For a pore diameter of 500 nm or 1000 nm, the dimensions were scaled by 2 and 4 times, respectively, as compared to a pore diameter of 250 nm.

The porous substrate design for this study was focused on understanding the effects of periodicity on production and performance, as well as controlling the overall stoichiometry of the system. Patterns to create samples on a 6" SOI wafer with pore sizes of 250 nm, 500 nm, and 1000 nm were generated. The design for the 250 nm pore regions is shown in FIG. 11, with the approximate chemical cell for each local reaction area highlighted. For the larger pore sizes, all the dimensions were simply scaled. The spacing of the pores was arranged so that hexagonal chemical cells around each pore were created, with the spacing necessary to provide a $SiPt_2$ reaction (as in Eq. 1b) when the pores are filled. The overall design allowed for several pore designs to be produced using a single SOI wafer.

Figure 12:
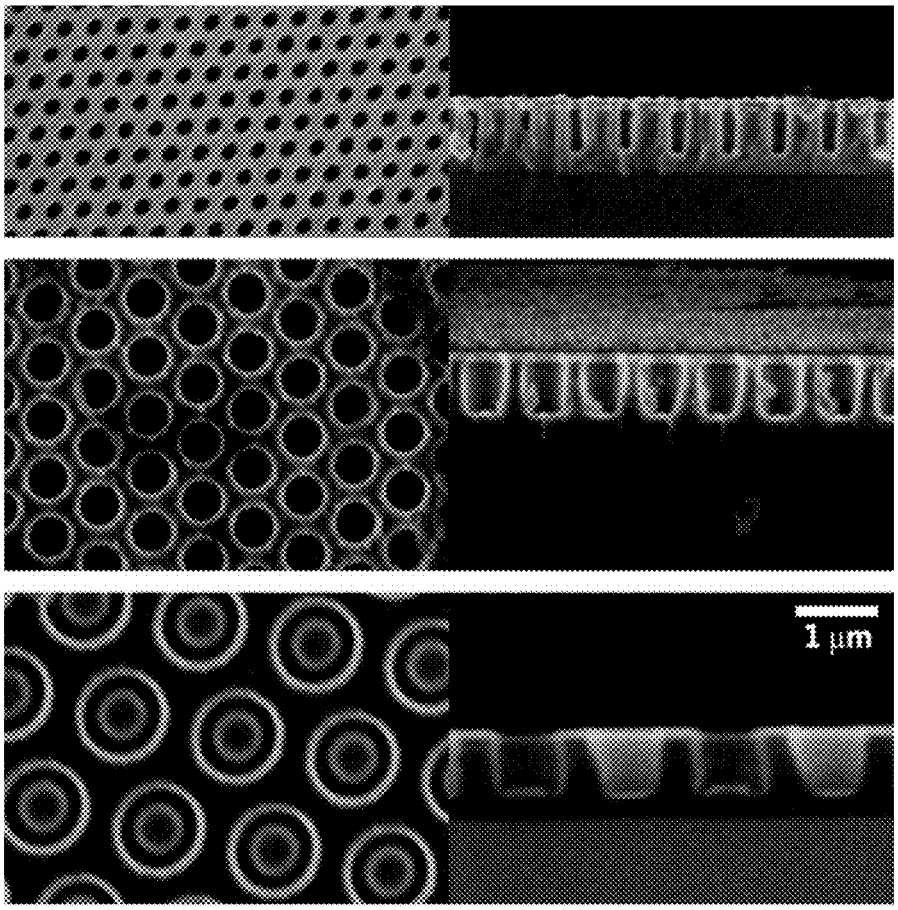
FIG. 12 shows microphotographs of etched Si substrates in plan views (left) and in fractured cross-sectional views (right). The etched pore sizes were 250 nm, 500 nm, and 1000 nm, respectively (from top to bottom).

A reticule was created using the pattern. This reticule allowed for generation of the photoresist (PR) masks necessary to create the patterned pores. A positive-cure PR coating on the wafer was U-cured using the reticule. Then, the uncured PR was removed, leaving behind bare Si at the location of the pores. Pores were then created using Bosch etching. The resulting pores are shown in FIG. 12.

Once the pores were created, the film PR was bonded to the porous surface. The purpose of this PR layer was to act as a handle after removal of the SOI wafer's Si handle layer. The Si handle layer was then back-etched, with the intention of full removal of the Si handle. Then, the insulator below the Si handle could be separately etched revealing porous Si on a cured-PR handle. The cured PR could then be removed either before or after Pt deposition.

With the tested pore dimensions and scaffold thickness, this process was unable to produce the freestanding porous Si materials that were desired. During the back-etch to remove the Si handle, the wafers spontaneously shattered when the overall thickness reached approximately 50 μm. It is believed that the high stresses in the insulative oxide cause this failure when the Si handle material becomes too thin to bear the residual stress. This catastrophic failure of the wafers occurred in all SOI wafers to reach the back-etch step of the production process, so this is believed to be a systemic failure condition, rather than an anomalous failure. This issue can be resolved by using a thicker scaffold layer and/or smaller openings. Alternatively, a new, revised production process was employed.

In order to create the materials that were planned, the production method for creating thin porous Si foils was modified. In the revised process, 100 μm Si wafers became the starting material, rather than SOI wafers. A reverse mask was used to create a PR mask with cured PR in the location of the pores. An alumina layer was deposited on the PR. Removing the PR then revealed an alumina mask with bare Si at the location of the pores. The alumina mask allows much greater selectivity during the etch process. Using this mask, pores were etched into the Si to a depth of approximately 20 μm. Then, a film PR was bonded to the newly porous side of the Si wafer to act as a handle after the next processing step. The next step was to back-etch the Si until the pores were visible. This revised process allows for thinning of a single-crystal Si wafer to prevent the stress-induced fracturing associated with the high internal stress laminated SOI wafer. The resulting structures were then removed from the etch tool, the PR handle was removed by plasma ashing and dissolution, and the wafers were diced to produce individual samples with single periodicities. Porous samples were created using this process.

The second significant process step in creating the reactive materials was to back-fill the newly created pores with the second reactant, Pt. Since the Pt needs to be deposited in a way that allows for efficient pore filling, excellent conformality, and precise thickness control, it was decided to utilize ALD for this process. Deposition by ALD is done in four steps, via two half-reactions.

Figure 13:
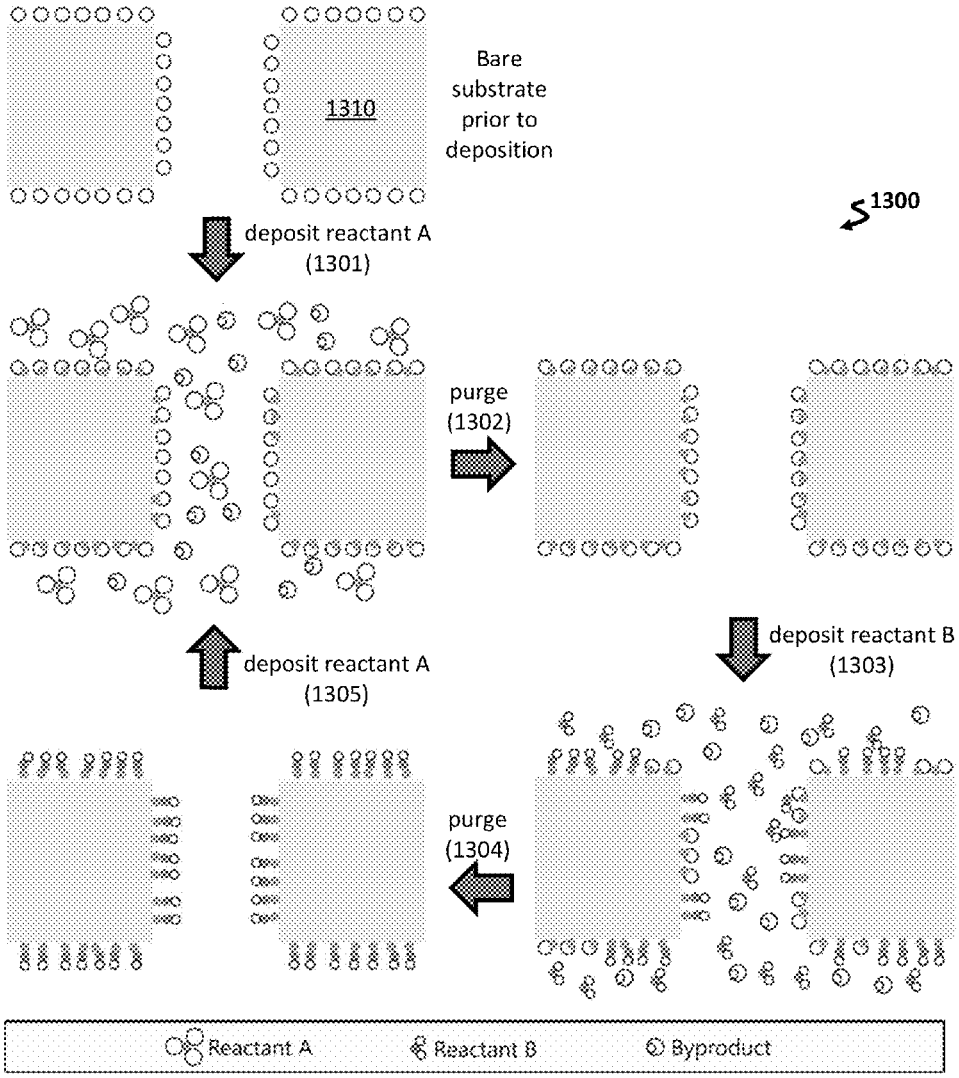
FIG. 13 shows a schematic of the atomic layer deposition (ALD) process 1300. The reaction begins by providing a substrate 1310 onto which the deposition will occur. In half-reaction 1, the first precursor is introduced 1301, adsorbing onto the surface. The remaining precursor is then purged 1302. Next, the second precursor is introduced 1303, which removes the organic ligands from the adsorbed molecules in the second half-reaction, depositing the desired material. Finally, the chamber is purged 1304 of precursor and products, and the cycle is ready to begin again (e.g., by introducing the first precursor 1305 and continuing in a cycle of steps 1302,1303,1304 until the desired layer(s) are deposited).

The ALD method 1300 and its associated steps are shown schematically in FIG. 13. In the initial condition, the material 1310 has a passivated surface. In the next step, a first precursor gas (precursor of reactant A) fills the chamber, and this precursor is deposited 1301 on the surface by physical adsorption. When the surface is saturated, the chamber is purged 1302 by evacuating the unreacted precursor. Then, a second precursor (precursor of reactant B) is introduced into the chamber and deposited 1303 on the pre-deposited layer of the first precursor. The second precursor then claims the organic ligand of the first precursor, leaving behind a reactant (e.g., a metal, metal oxide, or any useful layers thereof) deposited on the substrate 1310. The chamber is again purged 1304, and the steps (e.g., deposition steps 1303,1305 and purge steps 1302,1304) can be repeated until the desired reactant thickness is reached. Chemistries have been developed for a wide range of desired films. In this case, Pt was chosen due to the proclivity of Pt to react with Si.

The chemistry selected for the Pt deposition utilizes (cyclopentadienyl)trimethylplatinum and molecular oxygen as the two precursors. The global reaction proceeds through the two half-reactions taking place in a chamber heated to 300° C.:

$$Pt_{(solid)}+O_{2(gas)}\rightarrow Pt.O_x;\text{ and} \quad \text{(Eq. 2a)}$$

$$CH_3C_5H_4Pt(CH_3)_{3\ (gas)}+Pt.O_x\rightarrow Pt_{(solid)}+CO_{2(gas)}+H_2O_{(gas)}+\text{other.} \quad \text{(Eq. 2b)}$$

The composite material exhibited exothermic behavior during differential scanning calorimetry testing. The reaction behavior of the materials was characterized by high-speed imaging, thermography, and calorimetry. The results were compared to behavior of sputter-deposited thin films with the same periodicities.

Example 2: Analysis of Deposition Process for Reactive Ignitable Solids

Figure 14:
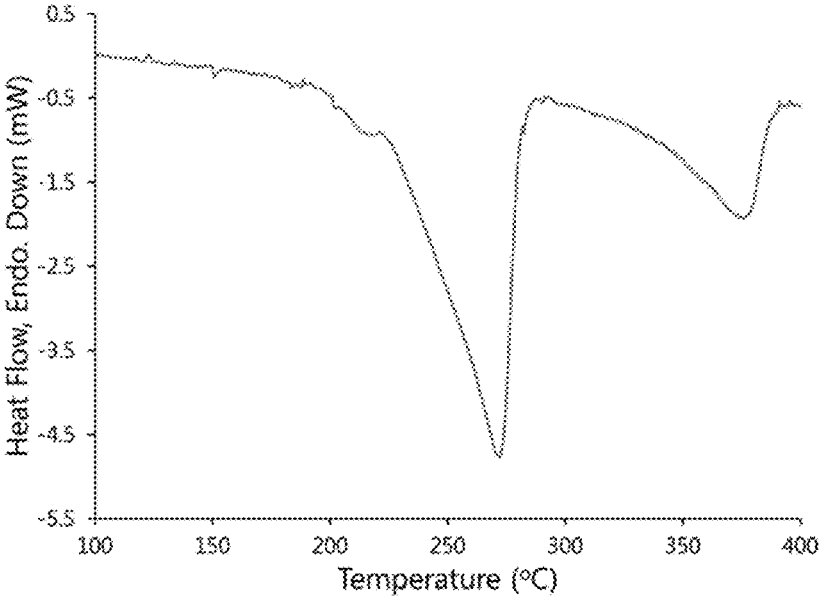
FIG. 14 shows a differential scanning calorimetry (DSC) trace for a nanolaminate of Si/Pt with a 100 nm bilayer (BL) thickness. The reaction onset appears to begin near 200° C., which is significantly above the deposition temperature used in the ALD process.

Various properties of the ignitable solids were determined. One question to be answered regarding the deposition process is whether or not metallic Pt can be deposited by ALD on single crystal Si without creating reaction products. A particular area of concern was the elevated deposition temperature required for delivering faster ALD reaction rates. It is known that nanolaminates have very low reaction onset temperatures, due to the high volume specific surface area between reactants. In fact, the sputter deposited Si/Pt nanolaminates used to verify system reaction behavior, as discussed above, exhibited reaction onsets in DSC testing at temperatures as low as 200° C. A representative DSC trace for a nanolaminate with BL thickness of 100 nm is shown in FIG. 14.

Figure 15:
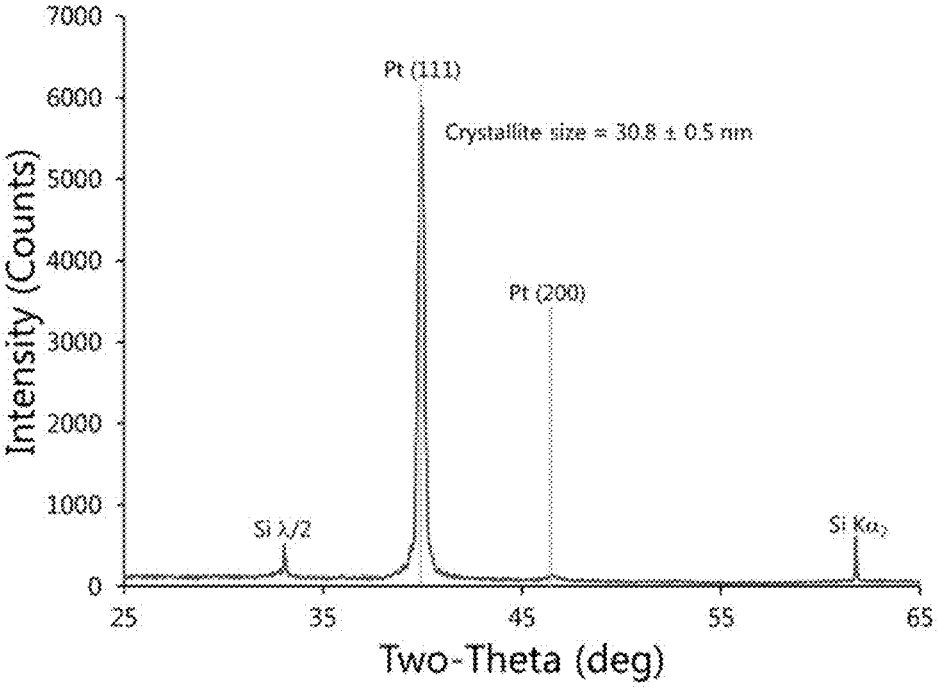
FIG. 15 shows an X-ray diffractogram for a 30 nm Pt deposition on Si taking place at 300° C. The only identifiable chemical phases are crystalline Si and elemental Pt. No product phases were apparent, despite the deposition taking place at a temperature that was in excess of the typical reaction onset temperature of nanometrically periodic Si/Pt.

To determine the chemical phase of the material after deposition, XRD was performed on witness samples. The samples were recovered pieces of porous Si created in the first etch process, which had shattered during the back etch. The resulting pieces consisted of porous Si on oxide on thinned Si handle. All three sizes of porosity were utilized. To create witness samples, a thin Pt deposition (~30 nm) was performed on these substrates. The material was then collected and analyzed by XRD to determine the chemical phases present. The resulting diffractogram and analysis can be seen in FIG. 15. In this sample, the only phases that are present are elemental Si and Pt. No intermetallic product phases were apparent. This suggests that despite the deposition temperature being high compared to the reaction onset temperature of a nanolaminate Si/Pt system, the ALD deposition results only in pure reactants. It is assumed that, since the volume specific interfacial area between reactants is similar in both material designs, this different reaction onset behavior is due to the different surface conditions between reactants of each type. Specifically, the nanolaminates were much more sensitive to thermal initiation of reaction due to the pristine interfaces between Si and Pt. In the materials made by the etch and fill process, the porous Si substrate likely has a more robust oxide surface, since it spends time in open atmosphere between processing steps. The resulting oxide can stabilize the surface and reduce the propensity of the material to react due to minor thermal inputs.

Thermal analysis was also performed on the samples analyzed by XRD. The small sample size (~5 mm×~5 mm) coupled with the thin layer of Pt deposited (26.0 nm) resulted in a small mass of reactive material to study (~10 to ~20 μg). Using the idealized heat release for the $SiPt_2$ formation reaction, the reaction is estimated to result in a heat release of 4.5 to 9 mJ of liberated energy. This is a very small signal for the DSC to recognize, especially considering that this reactive composite is still bonded to an oxide layer and a comparably massive Si handle. However, during DSC testing, heat releases of this magnitude were identified.

The onset temperature of reaction was above the ALD deposition temperature, suggesting that full Pt deposition can be accomplished without product formation, which would limit the total exothermicity of the composite. The tested materials were retained on Si substrate for handling. The results gathered from the materials created on Si handles suggests that the proposed process of created reactive materials by etching pores in Si and then backfilling through ALD is viable.

OTHER EMBODIMENTS

All publications, patents, and patent applications mentioned in this specification are incorporated herein by reference to the same extent as if each independent publication or patent application was specifically and individually indicated to be incorporated by reference.

While the invention has been described in connection with specific embodiments thereof, it will be understood that it is capable of further modifications and this application is intended to cover any variations, uses, or adaptations of the invention following, in general, the principles of the invention and including such departures from the present disclosure that come within known or customary practice within the art to which the invention pertains and may be applied to the essential features hereinbefore set forth, and follows in the scope of the claims.

Other embodiments are within the claims.

The invention claimed is:

1. An ignitable solid comprising:

a three-dimensional scaffold; and a plurality of ignitable regions, wherein each ignitable region is disposed within the scaffold and at least one ignitable region comprises a first reactant, and wherein the plurality of ignitable regions forms a three-dimensional array disposed within the scaffold, wherein each of the plurality of ignitable regions has a dimension that is of from about 10 nm to about 10 μm and each center-to-center spacing between two ignitable regions is of from about 10 nm to about 10 μm, and wherein the three-dimensional array extends in a pattern along x-, y-, and z-axes within the scaffold.

2. The ignitable solid of claim 1, wherein the scaffold comprises a second reactant, and wherein the first and second reactants are configured to undergo an exothermic reaction.

3. The ignitable solid of claim 2, wherein the first reactant and second reactant are configured as a multilayer.

4. The ignitable solid of claim 2, wherein the first and second reactants are configured to undergo an exothermic reaction that produces a non-transparent reaction product.

5. The ignitable solid of claim 2, wherein the first reactant is transparent or semi-transparent, wherein the second reactant is transparent or semi-transparent, and wherein the first and second reactants are configured to undergo and/or propagate an exothermic reaction that produces a non-transparent reaction product.

6. The ignitable solid of claim 1, wherein the ignitable region further comprises a second reactant, and wherein the first and second reactants are configured to undergo an exothermic reaction.

7. The ignitable solid of claim 1, wherein the scaffold comprises a plurality of openings, and wherein at least one ignitable region is disposed within at least one opening.

8. The ignitable solid of claim 1, wherein at least one ignitable region comprises a cylinder, a cone, or a multilayer.

9. The ignitable solid of claim 1, wherein the three-dimensional array comprises a periodic pattern.

10. The ignitable solid of claim 9, wherein the period pattern comprises a rectangular, a hexagonal, or a rhombohedral pattern.

11. The ignitable solid of claim 1, wherein the three-dimensional array comprises an aperiodic pattern.

12. The ignitable solid of claim 1, further comprising an ignition site in proximity to at least one of the plurality of ignitable regions.

13. The ignitable solid of claim 1, wherein at least one ignitable region has a dimension that is of from about 50 nm to about 1 μm.

14. The ignitable solid of claim 13, wherein a center-to-center spacing between two ignitable regions is of from about 10 nm to about 5 μm.

15. The ignitable solid of claim 1, wherein the solid is a foil, a coating, or a delay line.

16. The ignitable solid of claim 1, wherein the scaffold comprises silicon, carbon, aluminum, or a fluorocarbon.

17. The ignitable solid of claim 1, wherein at least one of the plurality of ignitable regions comprises one or more selected from the group consisting of a transition metal, a lanthanoid, and a metal oxide.

18. The ignitable solid of claim 17, wherein said at least one of the plurality of ignitable regions comprises nickel, platinum, cobalt, aluminum, titanium, zirconium, silicon, or an alloy thereof.

19. The ignitable solid of claim 1, wherein the solid is transparent.

20. An assembly comprising:

the ignitable solid of claim 1; and a first delay line located in proximity to the ignitable solid and configured to ignite the ignitable solid.

21. The assembly of claim 20, further comprising a substrate disposed between the first delay line and the ignitable solid.

22. The assembly of claim 21, further comprising a first ignitable via disposed within the substrate and configured to connect the first delay line and the ignitable solid.

23. The assembly of claim 20, wherein the first ignitable via comprises one or more reactants configured to undergo and/or propagate an exothermic reaction.

24. The assembly of claim 20, wherein the scaffold is composed of a material, and wherein the first reactant and the material are configured to undergo and/or propagate an exothermic reaction.

25. The assembly of claim 24, wherein the first reactant is transparent or semi-transparent, wherein the material is transparent or semi-transparent, and wherein the first reactant and the material are configured to undergo and/or propagate an exothermic reaction that produces a non-transparent reaction product.

26. The assembly of claim 20, wherein the first delay line comprises one or more reactants configured to undergo and/or propagate an exothermic reaction.

27. An optical switch comprising:

an ignitable solid of claim 1, wherein the solid comprises one or more transparent reactants configured to undergo and/or propagate an exothermic reaction that produces a non-transparent reaction product.

28. The ignitable solid of claim 1, further comprising an ignition mechanism.

29. The solid of claim 1, wherein the pattern along the x-axis comprises a plurality of first ignitable regions, the pattern along the y-axis comprises a plurality of second ignitable regions, and the pattern along the z-axis comprises a plurality of third ignitable regions.

30. An assembly comprising:

a three-dimensional scaffold;

a plurality of ignitable regions, wherein each ignitable region is disposed within the scaffold and at least one ignitable region comprises a first reactant; and a first delay line having a first end and a second end, wherein the first end is disposed in proximity to an ignition site, wherein the plurality of ignitable regions forms a three-dimensional array disposed within the scaffold, wherein each of the plurality of ignitable regions has a dimension that is of from about 10 nm to about 10 μm and each center-to-center spacing between two ignitable regions is of from about 10 nm to about 10 μm, and wherein the three-dimensional array extends in a pattern along x-, y-, and z-axes within the scaffold.

31. The assembly of claim 30, wherein the second end of the first delay line is disposed in proximity to at least one of the plurality of ignitable regions.

32. The assembly of claim 30, further comprising:

a first ignitable via disposed within a substrate and configured to connect the first delay line and said at least one ignitable region, wherein the substrate disposed between the first delay line and the scaffold.

33. The assembly of claim 30, further comprising:

a substrate disposed between the scaffold and the first delay line, wherein the substrate comprises an ignitable via configured to connect the first delay line to at least one ignitable region.

34. The assembly of claim 30, wherein the first delay line comprises one or more reactants configured to undergo and/or propagate an exothermic reaction.

* * * * *